US011091342B2

(12) United States Patent
Yokawa

(10) Patent No.: US 11,091,342 B2
(45) Date of Patent: Aug. 17, 2021

(54) PAPER SHEET STORAGE DEVICE AND PAPER SHEET HANDLING MACHINE

(71) Applicant: GLORY LTD., Hyogo (JP)

(72) Inventor: Takeshi Yokawa, Hyogo (JP)

(73) Assignee: GLORY LTD., Hyogo (JP)

( * ) Notice: Subject to any disclaimer, the term of this patent is extended or adjusted under 35 U.S.C. 154(b) by 256 days.

(21) Appl. No.: 16/362,884

(22) Filed: Mar. 25, 2019

(65) Prior Publication Data

US 2019/0291997 A1 Sep. 26, 2019

(30) Foreign Application Priority Data

Mar. 26, 2018 (JP) ..... JP2018-058341

(51) Int. Cl.
*B65H 5/28* (2006.01)
*B65H 29/00* (2006.01)

(52) U.S. Cl.
CPC ..... *B65H 29/006* (2013.01); *B65H 5/28* (2013.01); *B65H 2301/41912* (2013.01); *B65H 2403/732* (2013.01); *B65H 2515/32* (2013.01); *B65H 2701/1912* (2013.01)

(58) Field of Classification Search
CPC ..... B65H 29/006; B65H 5/28; B65H 2701/1912; B65H 2515/32
See application file for complete search history.

(56) References Cited

U.S. PATENT DOCUMENTS 8,955,837 B2 2/2015 Yin et al.
2009/0188631 A1* 7/2009 Noh ..... B65H 5/28 156/459
2012/0181298 A1* 7/2012 Miki ..... G07D 11/12 221/71
2014/0090949 A1 4/2014 Suetaka

FOREIGN PATENT DOCUMENTS

JP 2013-199365 A 10/2013
JP 2014-002720 A 1/2014

* cited by examiner

*Primary Examiner* — Sang K Kim
(74) *Attorney, Agent, or Firm* — Greenblum & Bernstein, P.L.C.

(57) ABSTRACT

In a storage operation, a first tape and a second tape are wound around a drum with a paper sheet sandwiched therebetween to store the paper sheet, the first tape being positioned outside the paper sheet in a radial direction of the drum. In a feeding operation, the first tape is wound around a first reel, and the second tape is wound around a second reel to feed the paper sheet from the drum. In at least one of the storage operation or the feeding operation, greater tension acts on the first tape than on the second tape.

11 Claims, 18 Drawing Sheets

PAPER SHEET STORAGE DEVICE AND PAPER SHEET HANDLING MACHINE

CROSS-REFERENCE TO RELATED APPLICATION

This application claims priority to Japanese Patent Application No. 2018-058341 filed on Mar. 26, 2018, the entire disclosure of which is incorporated by reference herein.

BACKGROUND

Japanese Unexamined Patent Publication No. 2013-199365 discloses a medium storage and feeding device that stores or feeds a medium by winding or rewinding a pair of tapes with the medium held between tape reels and a drum. The medium storage and feeding device includes a plurality of sets of tapes, a plurality of sets of tape reels that respectively wind up the plurality of sets of tapes, two reel rotation axle shafts that are rotation axles of the tape reels and are separately provided for one tape reel and another tape reel of the respective sets, a drum that winds the medium nipped by the plurality of sets of tapes together with the plurality of sets of tapes, and torque controllers that are independently provided at each of the tape reels and that control torques between the tape reels and the reel axle shafts such that tensions on the tapes between the tape reels and the drum are constant.

SUMMARY

However, according to Japanese Unexamined Patent Publication No. 2013-199365, the tension acting on each of the two tapes wound around the drum with the paper sheets sandwiched therebetween may not be kept constant at all times due to uneven performance of the torque controllers, uneven shape or strength of the tapes, and/or difference in reel winding diameters. In particular, when one of the tapes, which are wound around the drum with the paper sheets sandwiched therebetween, positioned outside the paper sheets in the radial direction of the drum receives a smaller tension than the other tape positioned inside the paper sheets in the radial direction of the drum, the tape positioned outside the paper sheets in the radial direction of the drum is easily loosened. This may easily deteriorate the winding state of the paper sheets on the drum.

In view of the foregoing, an object of the present disclosure is to provide a paper sheet storage device capable of reducing the deterioration of the winding state of paper sheets on a drum.

The present disclosure relates to a paper sheet storage device performing a storage operation of storing a paper sheet sent into the device and a feeding operation of feeding the paper sheet. The paper sheet storage device includes: a first tape; a second tape; a first reel configured to wind the first tape from one end of the first tape; a second reel configured to wind the second tape from one end of the second tape; and a drum configured to wind the first tape and the second tape from other ends of the first tape and the second tape. In the storage operation, the first tape and the second tape are wound around the drum with the paper sheet sandwiched therebetween to store the paper sheet, the first tape being positioned outside the paper sheet in a radial direction of the drum. In the feeding operation, the first tape is wound around the first reel and the second tape is wound around the second reel to feed the paper sheet from the drum.

In at least one of the storage operation or the feeding operation, greater tension acts on the first tape than on the second tape.

In this configuration, in the storage operation (or the feeding operation), the tension acting on the first tape is made greater than that acting on the second tape. Thus, when the first and second tapes are wound around the drum with the paper sheet sandwiched therebetween, the first tape positioned outside the paper sheet in the radial direction of the drum can be tightly wound around the drum. This can make the first tape less loosened in the storage operation (or the feeding operation), and can reduce the deterioration of a winding state of the paper sheet on the drum.

The paper sheet storage device may include a torque controller which controls a torque acting on the first reel and a torque acting on the second reel.

In this configuration, controlling the torque acting on the first reel can control the tension acting on the first tape, and controlling the torque acting on the second reel can control the tension acting on the second tape.

The torque controller may include a first torque limiter which regulates the torque acting on the first reel and a second torque limiter which regulates the torque acting on the second reel. The maximum torque of the first reel regulated by the first torque limiter is greater than the maximum torque of the second reel regulated by the second torque limiter.

In this configuration, the maximum torque of the first reel is greater than that of the second reel. As the torque acting on the first reel increases, the tension acting on the first tape tends to increase. Likewise, as the torque acting on the second reel increases, the tension acting on the second tape tends to increase. Consequently, when the maximum torque of the first reel is made greater than that of the second reel, the tension acting on the first tape can be made greater than that acting on the second tape. This can make the first tape less loosened, and can reduce the deterioration of the winding state of the paper sheet on the drum.

The paper sheet storage device may include a first driver which rotationally drives the first reel, and a second driver which rotationally drives the second reel. In at least one of the storage operation or the feeding operation, the torque controller controls the first driver and the second driver such that the torque acting on the first reel when the first driver rotationally drives the first reel is greater than the torque acting on the second reel when the second driver rotationally drives the second reel.

In this configuration, the first driver and the second driver are controlled, so that the tension acting on the first tape can be made greater than that acting on the second tape in the storage operation (or the feeding operation). Thus, the first tape can be wound more tightly around the drum than the second tape, thereby making the first tape less loosened in the storage operation (or the feeding operation). This can reduce the deterioration of the winding state of the paper sheet on the drum.

A winding diameter of the first tape on the first reel is smaller than a winding diameter of the second tape on the second reel.

In this configuration, the winding diameter of the first tape on the first reel is smaller than that of the second tape on the second reel. As the winding diameter of the first tape on the first reel decreases, the tension acting on the first tape tends to increase. Likewise, as the winding diameter of the second tape on the second reel decreases, the tension acting on the second tape tends to increase. Consequently, when the winding diameter of the first tape on the first reel is made smaller than that of the second tape on the second reel, the tension acting on the first tape can be made greater than that acting on the second tape. This can make the first tape less loosened, and can reduce the deterioration of the winding state of the paper sheet on the drum.

The first tape may be thicker than the second tape.

In this configuration, the first tape is made thicker than the second tape, thereby improving durability of the first tape against the tension. This can reduce the deterioration of the first tape due to the tension. Furthermore, the strength of the first tape against reaction force of the paper sheet sandwiched between the first tape and the second tape can be improved, and the paper sheet can be tightly wound around the drum by the first tape. This can reduce the deterioration of the winding state of the paper sheet on the drum. Furthermore, when the second tape is made thinner than the first tape, the apparent radius of the drum can be reduced.

The first tape may be wider than the second tape.

In this configuration, the first tape is made wider than the second tape, thereby improving durability of the first tape against the tension. This can reduce the deterioration of the first tape due to the tension. Furthermore, a contact area between the first tape and the paper sheet can be increased, and the paper sheet can be tightly wound around the drum by the first tape. This can reduce the deterioration of the winding state of the paper sheet on the drum.

The First Tape may have Higher Rigidity than the Second Tape.

In this configuration, the first tape is provided with higher rigidity than the second tape, thereby improving durability of the first tape against the tension. This can reduce the deterioration of the first tape due to the tension. Furthermore, the strength of the first tape against the reaction force of the paper sheet sandwiched between the first tape and the second tape can be improved, and the paper sheet can be tightly wound around the drum by the first tape. This can reduce the deterioration of the winding state of the paper sheet on the drum.

The first and second tapes may be wound around the drum to overlap with each other in the radial direction of the drum.

The first and second tapes may be wound around the drum not to overlap each other in the radial direction of the drum.

The present disclosure relates to a paper sheet handling machine, and the paper sheet handling machine includes the paper sheet storage device described above.

In this configuration, since the deterioration of the winding state of the paper sheet on the drum can be reduced, the frequency of pause of the paper sheet handling machine caused by a winding failure of the paper sheet in the paper sheet storage device can be reduced.

DETAILED DESCRIPTION

Figure 1:
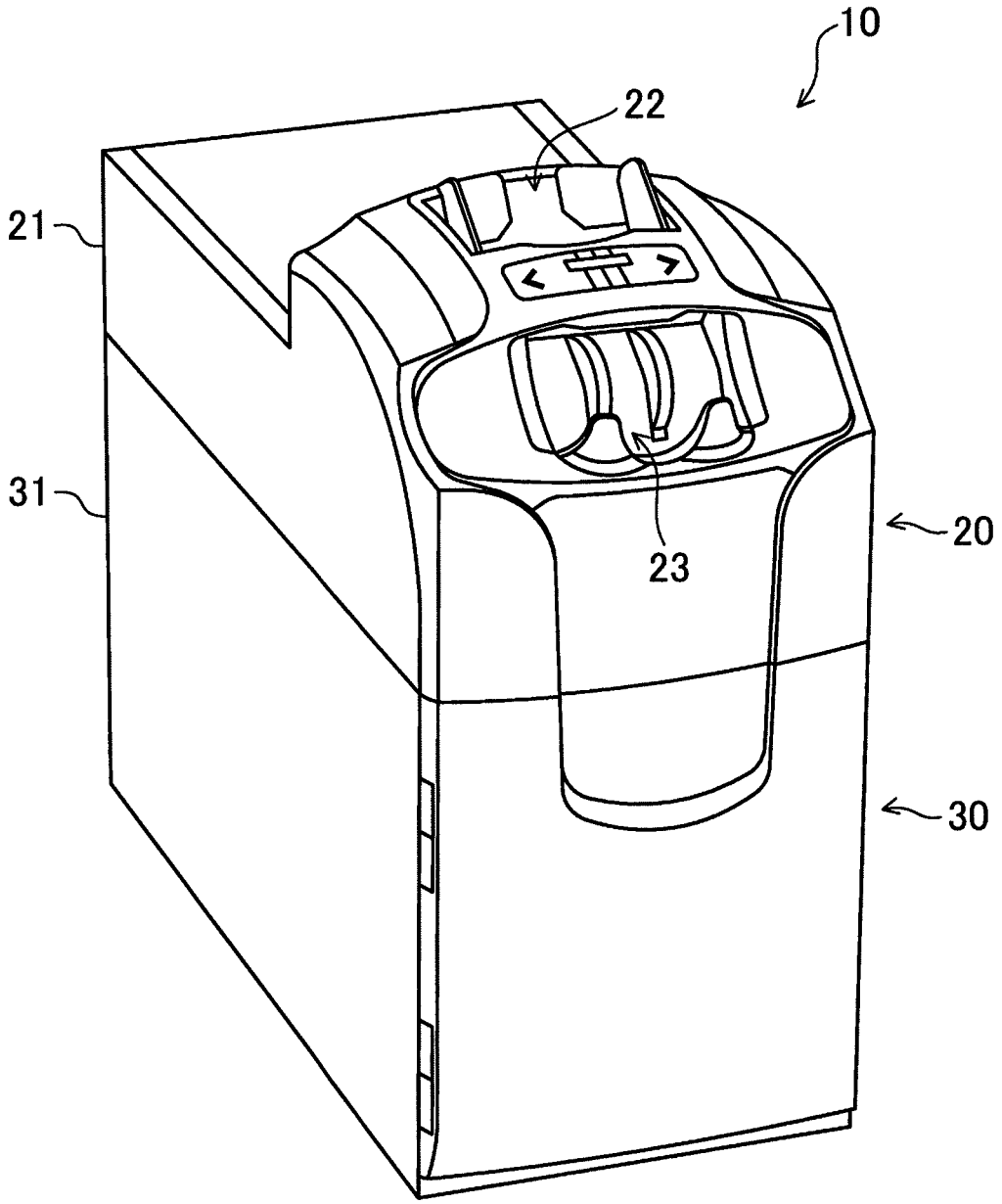
FIG. 1 is a schematic perspective view illustrating an external appearance of a paper sheet handling machine.

Embodiments will be described in detail below with reference to the drawings. In the drawings, the same elements or corresponding elements are denoted by the same reference numerals, and a description thereof is not repeated.

Paper Sheet Handling Machine

Figure 2:
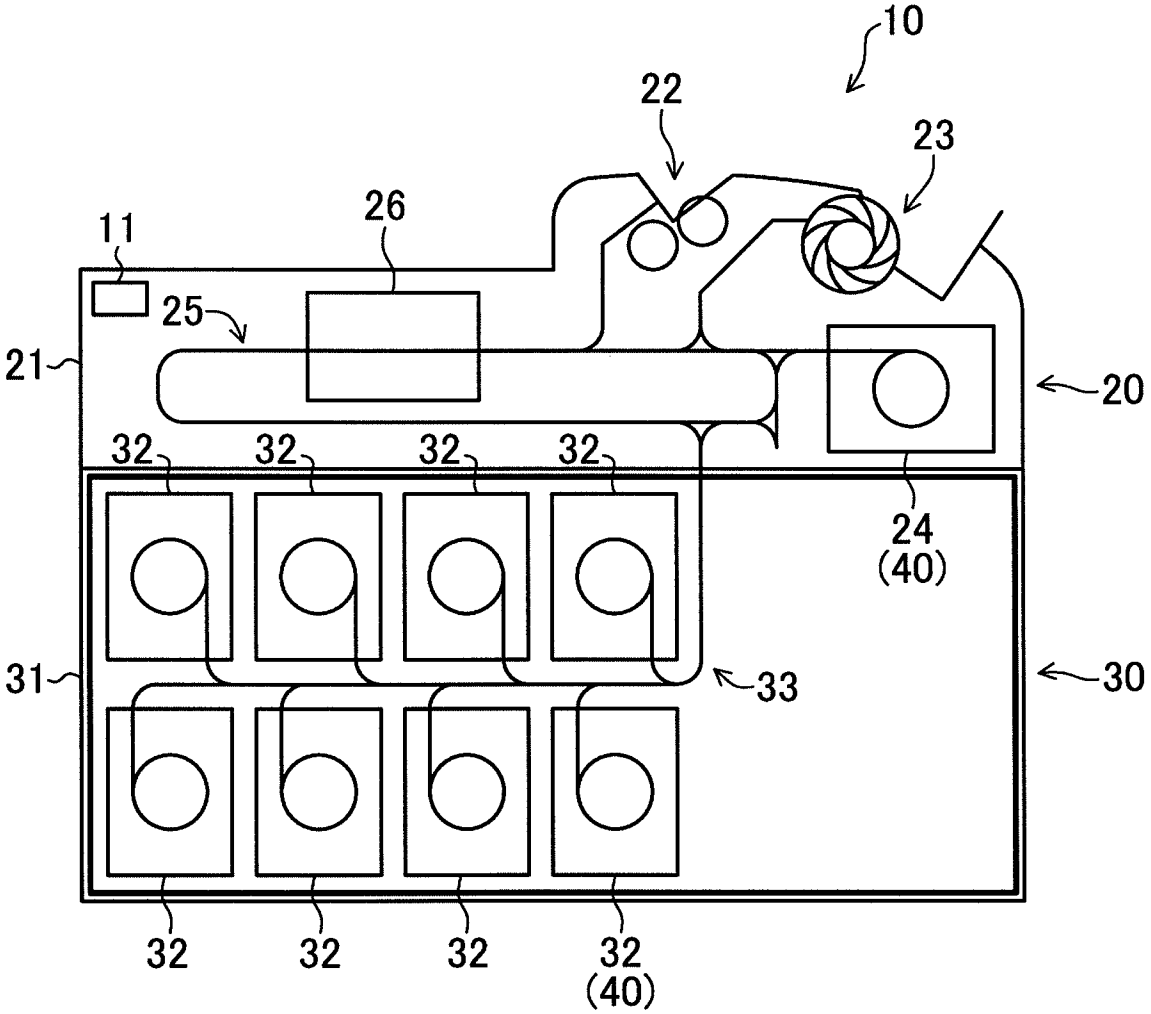
FIG. 2 is a schematic view illustrating an internal configuration of the paper sheet handling machine.

FIG. 1 and FIG. 2 illustrate an external appearance and internal configuration of a paper sheet handling machine 10 according to an embodiment. The paper sheet handling machine 10 is configured to handle paper sheets. In this example, the paper sheet handling machine 10 is configured as a banknote handling machine which handles banknotes (an example of the paper sheets). Such a banknote handling machine is installed, for example, in a financial institution such as a bank, or a back office of a retail store.

The paper sheet handling machine 10 includes a handling unit 20, a safe unit 30, and a controller 11. The handling unit 20 has a handling unit housing 21, a depositing unit 22, a dispensing unit 23, a temporary storage 24, a transport unit 25 in the handling unit, and a recognition unit 26. The safe unit 30 has a safe housing 31, a plurality of (eight in this example) storages 32, and a transport unit 33 of the safe.

[Handling Unit Housing]

The handling unit housing 21 is formed in a rectangular parallelepiped box shape and houses the depositing unit 22, the dispensing unit 23, the temporary storage 24, the recognition unit 26, and the transport unit 25 in the handling unit.

[Depositing Unit]

The depositing unit 22 is configured to receive banknotes placed therein. In this example, the depositing unit 22 has an inlet opened in an upper surface of the handling unit housing 21, and is configured to receive the banknotes placed therein through the inlet. The depositing unit 22 is provided with a feeding mechanism that feeds the banknotes placed in the depositing unit 22 to the transport unit 25 in the handling unit one by one.

[Dispensing Unit]

The dispensing unit 23 is configured to dispense the banknotes. In this example, the dispensing unit 23 has an outlet opened in the upper surface of the handling unit housing 21, and is configured to stack a plurality of banknotes therein. The banknotes stacked in the dispensing unit 23 are fed from the dispensing unit 23 through the outlet. The dispensing unit 23 may be provided with a shutter that covers or uncovers the outlet.

[Temporary Storage]

The temporary storage 24 is configured to temporarily retain (store) the banknotes, and feed the temporarily stored banknotes. In this example, the temporary storage 24 consists of a paper sheet storage device 40. The paper sheet storage device 40 will be described in detail later.

[Transport Unit in the Handling Unit]

The transport unit 25 in the handling unit is configured to transport the banknotes in the handling unit 20. In this example, the transport unit 25 in the handling unit has a transport path connected to the depositing unit 22, the dispensing unit 23, the temporary storage 24, and the transport unit 33 in the safe. The transport unit 25 is configured to transport the banknotes among the depositing unit 22, the dispensing unit 23, the temporary storage 24, and the transport unit 33 in the safe. In this example, the transport unit 25 in the handling unit transports the banknotes such that short edges of the banknotes coincide with the transport direction. The transport path of the transport unit 25 in the handling unit is provided with, for example, a transport mechanism (e.g., a plurality of rollers or belts) for transporting the banknotes, a guide member for guiding the banknotes being transported, a branch mechanism (e.g., a branching pawl) for switching the transport direction of the banknotes, and a passage sensor for detecting the passage of the banknotes. The transport unit 25 in the handling unit has, for example, a drive mechanism (e.g., a motor or a gear) for driving the transport mechanism and the branch mechanism provided on the transport path.

[Recognition Unit]

The recognition unit 26 is configured to perform recognition of the banknotes. In the recognition, whether the banknotes are genuine or not, the denomination of the banknotes, and whether the banknotes are fit or unfit are recognized. In this example, the recognition unit 26 is provided in the transport path of the transport unit 25 in the handling unit, and is configured to perform the recognition of the banknotes passing through the transport path. For example, the recognition unit 26 includes various sensors such as a line sensor, a magnetic sensor, and an image sensor, a processing unit such as a CPU, and a storage unit such as a memory for storing a program and information for operating the processing unit.

[Safe Housing]

The safe housing 31 is formed in a rectangular parallelepiped box shape, and houses the storages 32 and the transport unit 33 in the safe. The safe housing 31 has higher protection level than the housing 21 of the handling unit.

[Storage]

Each storage 32 is configured to store the banknotes and feed the stored banknotes. For example, the storage 32 is configured as a denomination-specific storage that stores the banknotes of a previously assigned denomination. Alternatively, the storage 32 may be configured as a mixed storage that stores banknotes of a plurality of denominations. In this example, the storage 32 consists of the paper sheet storage device 40. The paper sheet storage device 40 will be described in detail later.

[Transport Unit in the Safe]

The transport unit 33 in the safe is configured to transport the banknotes in the safe unit 30. In this example, the transport unit 33 in the safe has a transport path connected to the plurality of storages 32 and the transport unit 25 in the handling unit, and is configured to transport the banknotes among the plurality of storages 32 and the transport unit 25 in the handling unit. In this example, just like the transport unit 25 in the handling unit, the transport unit 33 in the safe also transports the banknotes such that the short edges of the banknotes coincide with the transport direction. The transport path of the transport unit 33 in the safe is provided with, for example, a transport mechanism (e.g., a plurality of rollers or belts) for transporting the banknotes, a guide member for guiding the banknotes being transported, a branch mechanism (e.g., a branching pawl) for switching the transport direction of the banknotes, and a passage sensor for detecting the passage of the banknotes. The transport unit 33 in the safe has, for example, a drive mechanism (e.g., a motor or a gear) for driving the transport mechanism and the branch mechanism provided on the transport path.

[Controller]

The controller 11 is connected to the units of the paper sheet handling machine 10 (the depositing unit 22, the dispensing unit 23, the temporary storage 24, the transport unit 25 in the handling unit, the recognition unit 26, the storages 32, and the transport unit 33 in the safe in this example) so as to be able to transmit and receive signals to and from these units. The controller 11 receives detection signals of various sensors (e.g., the passage sensor) provided for the paper sheet handling machine 10. In accordance with the signals or information from the units and sensors of the paper sheet handling machine 10, the controller 11 controls each unit of the paper sheet handling machine 10, thereby controlling the paper sheet handling machine 10 to perform various processes (e.g., a depositing process and a dispensing process). For example, the controller 11 includes a processing unit such as a CPU, and a storage unit such as a memory for storing a program and information for operating the processing unit.

[Paper Sheet Storage Device]

Referring to FIG. 3 to FIG. 6, the paper sheet storage device 40 will be described. The paper sheet storage device 40 is configured to perform a storage operation of storing the paper sheets (banknotes in this example) sent into the device, and a feeding operation of feeding the paper sheets stored in the storage operation. In this example, the paper sheet storage device 40 includes a housing 41 and a storage mechanism 42.

Figure 3:
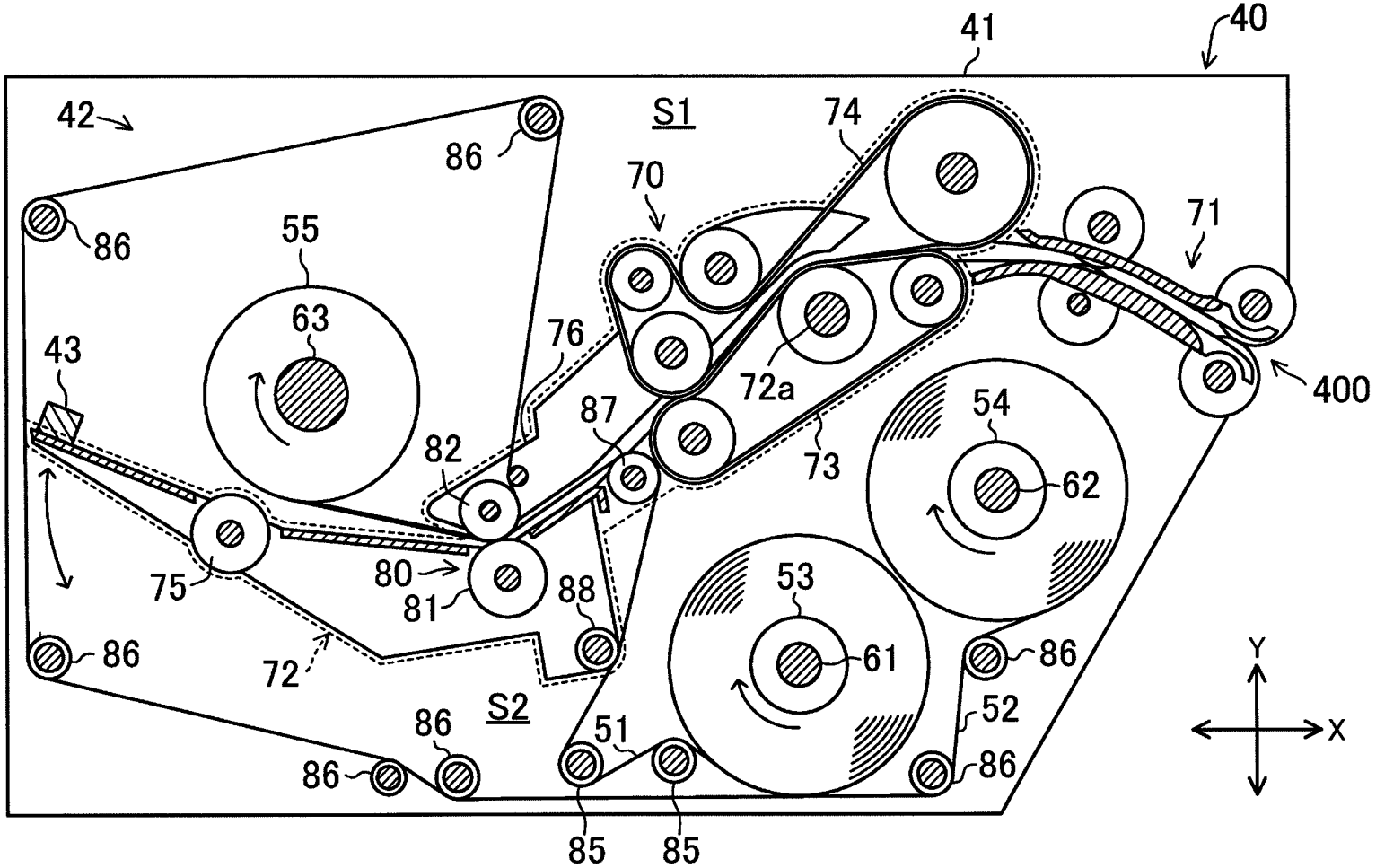
FIG. 3 is a schematic sectional view illustrating a configuration of the paper sheet storage device.
Figure 4:
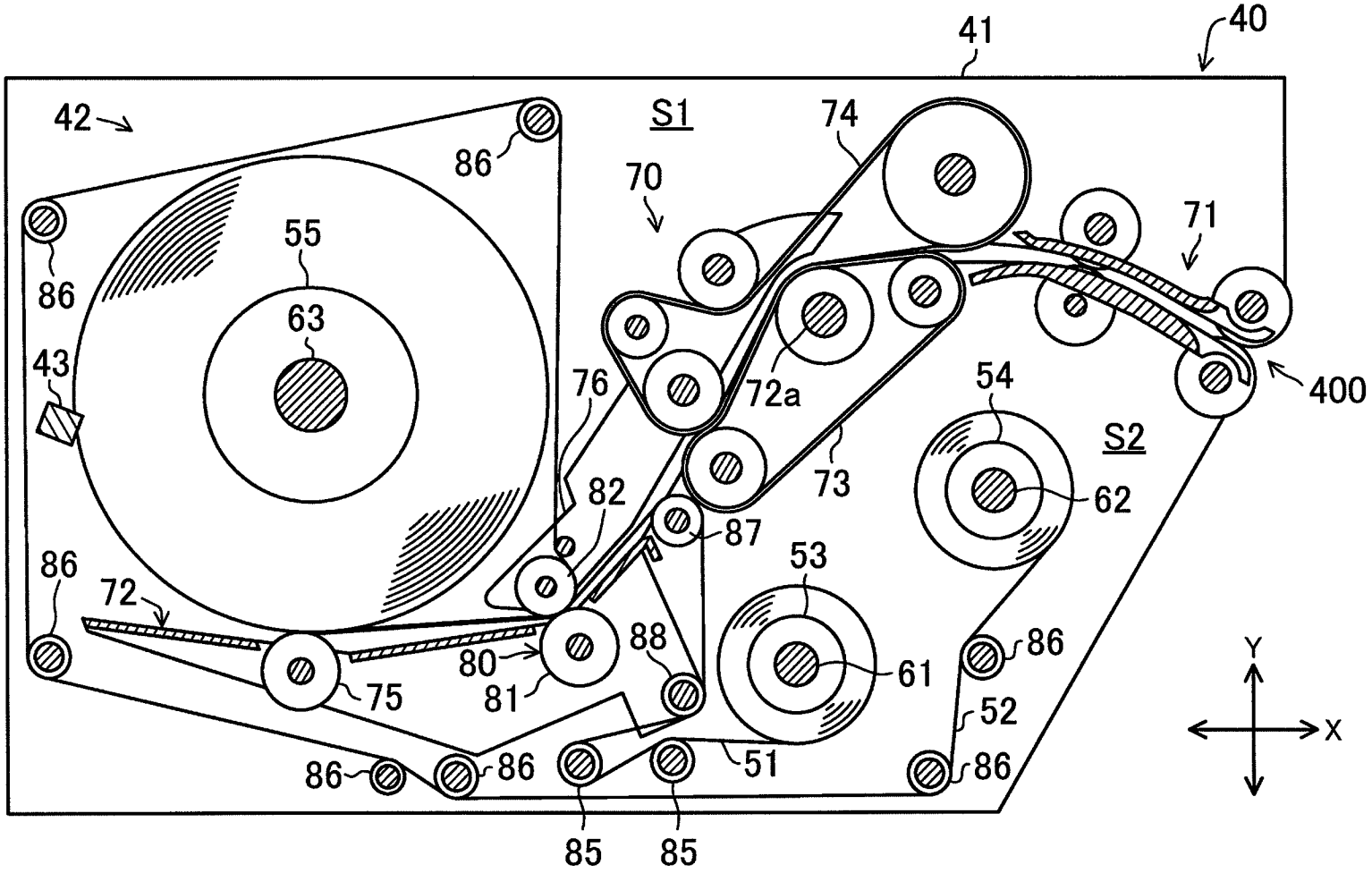
FIG. 4 is a schematic sectional view illustrating a configuration of the paper sheet storage device.
Figure 6:
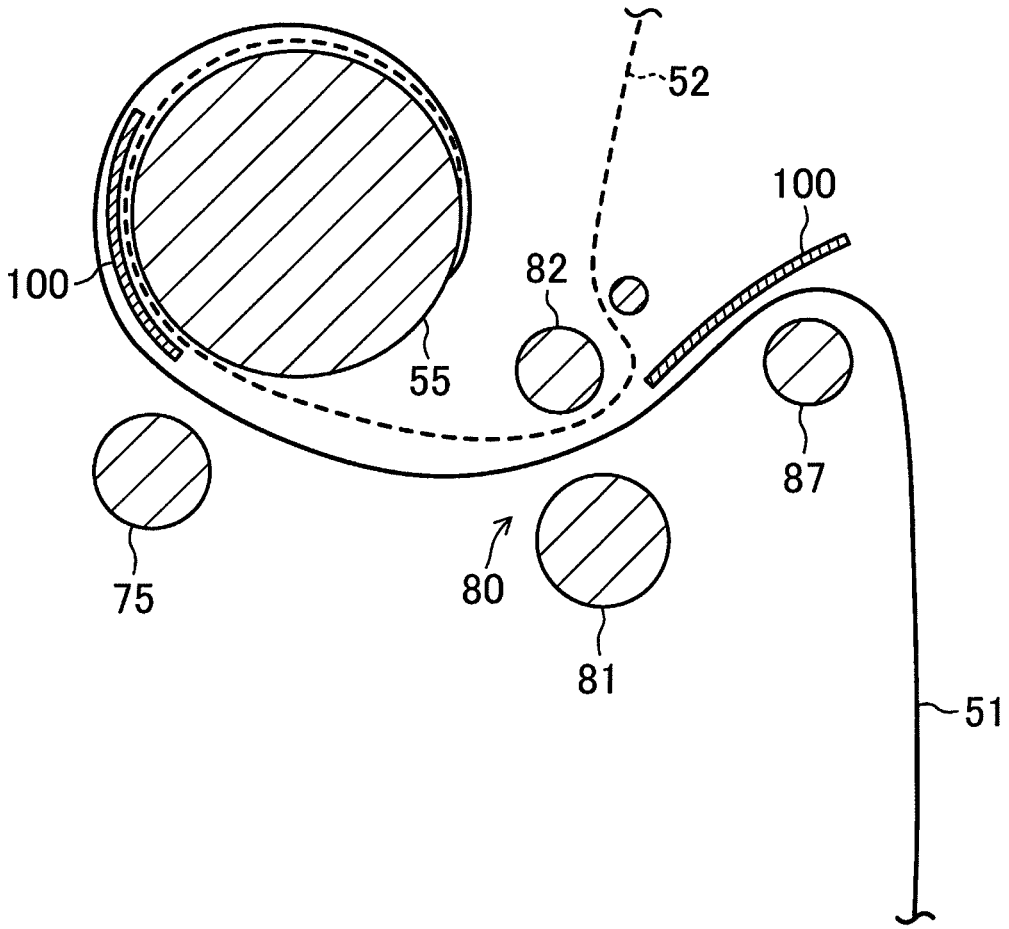
FIG. 6 is a conceptual view illustrating a major part of the paper sheet storage device.

FIG. 3 illustrates the paper sheet storage device 40 in which no paper sheet is stored, and FIG. 4 illustrates the paper sheet storage device 40 in which the maximum number of paper sheets are stored. In FIG. 6, for the sake of easy understanding, the units of the paper sheet storage device 40 are widely spaced from each other, a first tape 51 is indicated by a solid line, and a second tape 52 is indicated by a broken line.

For the convenience of description, the horizontal direction on the paper surface of FIG. 3 and FIG. 4 will be referred to as an "X axis direction," the vertical direction on the paper surface of FIG. 3 and FIG. 4 will be referred to as a "Y axis direction," and the direction perpendicular to the paper surface of FIG. 3 and FIG. 4 will be referred to as a "Z axis direction."

[Housing]

The housing 41 is formed in a rectangular parallelepiped box shape, and houses the storage mechanism 42. The housing 41 is provided with an inlet/outlet port 400. The inlet/outlet port 400 is configured to be able to allow the paper sheets to pass through. In this paper sheet storage device 40, the paper sheets are stored and fed through the inlet/outlet port 400.

[Storage Mechanism]

Figure 5:
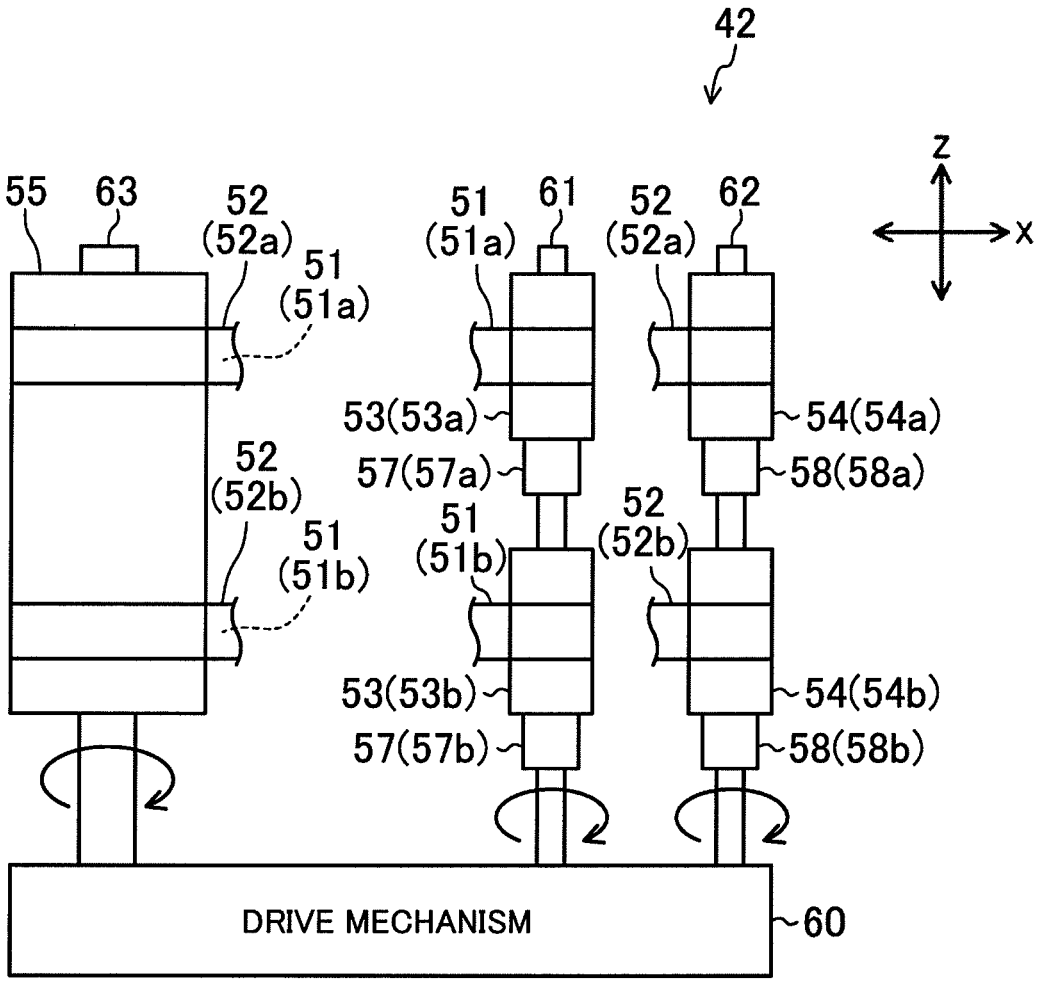
FIG. 5 is a schematic plan view illustrating a major part of the paper sheet storage device.

The storage mechanism 42 includes the first tape 51, the second tape 52, a first reel 53, a second reel 54, and a drum 55. As illustrated in FIG. 5, in this example, the storage mechanism 42 includes a first reel shaft 61, a second reel shaft 62, a drum shaft 63, a first torque limiter 57, a second torque limiter 58, and a drive mechanism 60.

<First and Second Tapes>

Each of the first and second tapes 51 and 52 is formed in a belt shape.

As illustrated in FIG. 5, in this example, a pair of first tapes 51 and a pair of second tapes 52 are provided. That is, the paper sheet storage device 40 includes two first tapes 51 and two second tapes 52. In the following description, one of the two first tapes 51 will be referred to as a "first tape 51*a*" and the other will be referred to as a "first tape 51*b*," and one of the two second tapes 52 will be referred to as a "second tape 52*a*" and the other will be referred to as a "second tape 52*b*." In this example, the two first tapes 51*a* and 51*b* are arranged in the Z axis direction, and the two second tapes 52*a* and 52*b* are arranged in the Z axis direction.

<First and Second Reels>

One end of each first tape 51 and one end of each second tape 52 are respectively connected to the first reel 53 and the second reel 54. The first and second reels 53 and 54 are configured to be able to wind the first and second tapes 51 and 52, respectively. Specifically, each of the first and second reels 53 and 54 is formed in a cylindrical shape. One end of the first tape 51 is fixed (e.g., with an adhesive) to an outer peripheral surface of the first reel 53, and one end of the second tape 52 is fixed (e.g., with an adhesive) to an outer peripheral surface of the second reel 54. In this example, a winding diameter of the first tape 51 on the first reel 53 is the same as a winding diameter of the second tape 52 on the second reel 54.

As illustrated in FIG. 5, in this example, a pair of first reels 53 and a pair of second reels 54 are provided. That is, the paper sheet storage device 40 includes two first reels 53 and two second reels 54 respectively corresponding to the two first tapes 51 and the two second tapes 52. In the following description, one of the two first reels 53 will be referred to as a "first reel 53*a*" and the other will be referred to as a "first reel 53*b*," and one of the two second reels 54 will be referred to as a "second reel 54*a*" and the other will be referred to as a "second reel 54*b*."

More specifically, in this example, the paper sheet storage device 40 includes the first reel 53*a* corresponding to the first tape 51*a* disposed at one side (an upper side in FIG. 5) in the Z axis direction, the first reel 53*b* corresponding to the first tape 51*b* disposed at the other side (a lower side in FIG. 5) in the Z axis direction, the second reel 54*a* corresponding to the second tape 52*a* disposed at one side in the Z axis direction, and the second reel 54*b* corresponding to the second tape 52*b* disposed at the other side in the Z axis direction.

<Drum>

The drum 55 is connected to the other end of the first tape 51 and the other end of the second tape 52. The drum 55 is configured to be able to wind the first tape 51 and the second tape 52. Specifically, the drum 55 is formed in a cylindrical shape. The other end of the first tape 51 and the other end of the second tape 52 are fixed (e.g., with an adhesive) to an outer peripheral surface of the drum 55.

As illustrated in FIG. 5, in this example, the first tape 51 and the second tape 52 are wound around the drum 55 to overlap with each other in the radial direction of the drum 55. That is, the position of the first tape 51 in the axial direction of the drum 55 is the same as that of the second tape 52 in the axial direction of the drum 55.

More specifically, in this example, the other ends of the two first tapes 51*a* and 51*b* and the other ends of the two second tapes 52*a* and 52*b* are connected to the drum 55. The first tape 51*a* and the second tape 52*a* are wound around the drum 55 to overlap with each other in the radial direction of the drum 55, and the first tape 51*b* and the second tape 52*b* are wound around the drum 55 to overlap with each other in the radial direction of the drum 55. That is, the first tape 51*a* and the second tape 52*a* are wound around the drum 55 at the same position in the axial direction of the drum 55. The first tape 51*b* and the second tape 51*b* are wound around the drum 55 at the same position in the axial direction of the drum 55. However, the position of the first tape 51*b* in the axial direction of the drum 55 is different from the positions of the first tape 51*a* and the second tape 52*a* in the axial direction of the drum 55.

<First and Second Reel Shafts and Drum Shaft>

As illustrated in FIG. 5, the first reel shaft 61 and the second reel shaft 62 respectively extend in the Z axis direction, and are supported to be rotatable in the housing 41. The drum shaft 63 extends in the Z axis direction and is supported to be rotatable in the housing 41. The drum 55 is fixed to the drum shaft 63.

<First and Second Torque Limiters>

As illustrated in FIG. 5, the first and second torque limiters 57 and 58 are respectively connected to the first and second reels 53 and 54, and are configured to respectively regulate a torque acting on the first reel 53 and a torque acting on the second reel 54. In this example, the first and second torque limiters 57 and 58 serve as torque controllers which respectively control the torque acting on the first reel 53 and the torque acting on the second reel 54.

Specifically, the first reel 53 is fixed to the first reel shaft 61 via the first torque limiter 57. The first torque limiter 57 is configured to connect the first reel 53 and the first reel shaft 61 to each other to transmit the torque between the first reel 53 and the first reel shaft 61 when the torque acting on the first reel 53 is smaller than a predetermined first set torque. The first reel 53 is also configured to disconnect the first reel 53 and the first reel shaft 61 from each other to block the transmission of the torque between the first reel 53 and the first reel shaft 61 when the torque acting on the first reel 53 increases to the first set torque.

Likewise, the second reel 54 is fixed to the second reel shaft 62 via the second torque limiter 58. The second torque limiter 58 is configured to connect the second reel 54 and the second reel shaft 62 to each other to transmit the torque between the second reel 54 and the second reel shaft 62 when the torque acting on the second reel 54 is smaller than a predetermined second set torque. The second torque limiter 58 is also configured to disconnect the second reel 54 and the second reel shaft 62 from each other to block the transmission of the torque between the second reel 54 and the second reel shaft 62 when the torque acting on the second reel 54 increases to the second set torque.

As illustrated in FIG. 5, in this example, a pair of first torque limiters 57 and a pair of second torque limiters 58 are provided. That is, in this example, the paper sheet storage device 40 includes two first torque limiters 57 and two second torque limiters 58 respectively corresponding to the two first reels 53 and the two second reels 54. In the following description, one of the two first torque limiters 57 will be referred to as a "first torque limiter 57*a*" and the other will be referred to as a "first torque limiter 57*b*," and one of the two second torque limiters 58 will be referred to as a "second torque limiter 58*a*" and the other will be referred to as a "second torque limiter 58*b*."

More specifically, in this example, the paper sheet storage device 40 includes the first torque limiter 57*a* connected to the first reel 53*a* to regulate the torque acting on the first reel 53*a*, the first torque limiter 57*b* connected to the first reel 53*b* to regulate the torque acting on the first reel 53*b*, the second torque limiter 58*a* connected to the second reel 54*a* to regulate the torque acting on the second reel 54*a*, and the second torque limiter 58*b* connected to the second reel 54*b* to regulate the torque acting on the second reel 54*b*. The first reel 53*a* is fixed to the first reel shaft 61 via the first torque limiter 57*a*. The first torque limiter 57*a* is configured to connect the first reel 53*a* and the first reel shaft 61 to each other to transmit the torque between the first reel 53*a* and the first reel shaft 61 when the torque acting on the first reel 53*a* is smaller than the first set torque. The first torque limiter 57*a* is configured to disconnect the first reel 53*a* and the first reel shaft 61 from each other to block the transmission of the torque between the first reel 53*a* and the first reel shaft 61 when the torque acting on the first reel 53*a* increases to the first set torque. The first torque limiter 57*b* and the second torque limiters 58*a* and 58*b* are configured in the same manner as the first torque limiter 57*a*.

<Drive Mechanism>

As illustrated in FIG. 5, the drive mechanism 60 is configured to rotationally drive the first reel shaft 61, the second reel shaft 62, and the drum shaft 63. For example, the drive mechanism 60 includes a motor that generates the torque, and a mechanical component (e.g., a gear or a one-way clutch) for transmitting the torque of the motor to the first reel shaft 61, the second reel shaft 62, and the drum shaft 63.

<Transport Guide>

As illustrated in FIG. 3 and FIG. 4, in this example, the drum 55 is disposed on a rear side (a side remote from the inlet/outlet port 400) of the housing 41, and the first reel 53 and the second reel 54 are disposed adjacent to the inlet/outlet port 400 of the housing 41. The storage mechanism 42 has a transport guide 70.

The transport guide 70 has a transport path (a transport path of the paper sheets) extending from the inlet/outlet port 400 toward the drum 55, and is configured to transport the paper sheets between the inlet/outlet port 400 and the drum 55. In this example, the transport guide 70 transports the banknotes such that short edges thereof coincide with the transport direction.

In this example, the transport guide 70 extends in the X axis direction in the housing 41 from the inlet/outlet port 400 toward the drum 55 (that is, toward the rear side of the housing 41). The transport guide 70 configured in this manner divides an internal space of the housing 41 into a first space S1 and a second space S2. The drum 55 is disposed in the first space S1. The first and second reels 53 and 54 are disposed in the second space S2. The transport guide 70 has a fixed guide 71 and a movable guide 72.

<Fixed Guide>

The fixed guide 71 has a transport path (a transport path of the paper sheets) extending from the inlet/outlet port 400 toward the movable guide 72, and is configured to transport the paper sheets between the inlet/outlet port 400 and the movable guide 72. In this example, the fixed guide 71 has a guide member forming the transport path of the paper sheets, a transport mechanism (four rollers in this example) for transporting the paper sheets, and a drive mechanism (e.g., a motor or a gear) for driving the transport mechanism.

<Movable Guide>

The movable guide 72 has a transport path (a transport path of the paper sheets) extending from the fixed guide 71 toward the drum 55, and is configured to transport the paper sheets between the fixed guide 71 and the drum 55. In FIG. 3, the movable guide 72 is encircled with a broken line.

In this example, the movable guide 72 has a guide member forming the transport path of the paper sheets, a first transport belt 73, a second transport belt 74, and a drive mechanism (e.g., a motor or a gear) for driving the first and second transport belts 73 and 74. The first transport belt 73 is rotatably wound around a plurality of (three in this example) pulleys. The second transport belt 74 is rotatably wound around a plurality of (four in this example) pulleys. The first and second transport belts 73 and 74 are provided at an end of the transport path of the movable guide 72 (an end closer to the fixed guide 71), and are disposed to face each other with a predetermined gap formed therebetween. The first and second transport belts 73 and 74 are configured to rotate with the paper sheets interposed therebetween, thereby transporting the paper sheets.

The movable guide 72 is configured to swing about a swing shaft 72*a* extending in the Z axis direction. In this example, the swing shaft 72*a* constitutes a rotating shaft of one of the three pulleys around which the first transport belt 73 is wound. Furthermore, a tip end portion of the movable guide 72 is biased in a direction approaching the drum 55 (a clockwise direction in FIG. 3) by a biasing member (e.g., a spring, not illustrated). A pressing roller 75 is provided at the tip end portion of the movable guide 72. The pressing roller 75 is configured to abut on an outer peripheral surface of the tape (the first tape 51 in this example) wound around the drum 55 to press the tape. The movable guide 72 configured in this manner swings about the swing shaft 72*a* extending in the Z axis direction, in accordance with a change in an apparent diameter of the drum 55 (i.e., a diameter of the outermost peripheral surface of the drum 55 with the first and second tapes 51 and 52 wound around the drum 55 and the paper sheets).

<First and Second Transport Rollers (Sandwiching Portion)>

In this example, the storage mechanism 42 includes a first transport roller 81 and a second transport roller 82. The first transport roller 81 and the second transport roller 82 are provided at the end of the transport path of the movable guide 72 (an end closer to the drum 55) and are disposed to face each other with a predetermined gap formed therebetween. The first transport roller 81 and the second transport roller 82 are configured to rotate with the first tape 51 and the second tape 52 sandwiched therebetween. The first transport roller 81 and the second transport roller 82 constitute a sandwiching portion 80 that sandwiches the paper sheets between the first tape 51 and the second tape 52.

<Guide Roller, Intermediate Roller, and Auxiliary Roller>

In this example, the storage mechanism 42 includes a plurality of (two in this example) first guide rollers 85, a plurality of (seven in this example) second guide rollers 86, an intermediate roller 87, and an auxiliary roller 88.

The plurality of first guide rollers 85 are provided in the first space S1. The intermediate roller 87 is provided at an intermediate portion of the movable guide 72 (specifically, a portion between the first transport belt 73 and the first transport roller 81). The plurality of first guide rollers 85 and the intermediate roller 87 are configured to guide the first tape 51 between the first reel 53 and the sandwiching portion 80. That is, in this example, the first tape 51 sequentially passes through the plurality of first guide rollers 85, the intermediate roller 87, and the sandwiching portion 80 to reach the drum 55 from the first reel 53.

Some (five in this example) of the plurality of second guide rollers 86 are disposed in the first space S1, and the rest (two in this example) of them are disposed in the second space S2. The plurality of second guide rollers 86 is configured to guide the second tape 52 between the second reel 54 and the sandwiching portion 80. That is, in this example, the second tape 52 sequentially passes through the plurality of second guide rollers 86 and the sandwiching portion 80 to reach the drum 55 from the second reel 54. In this example, the second tape 52 is routed from the first space S1 to the second space S2 to bypass the tip end of the movable guide 72.

The auxiliary roller 88 is provided at an intermediate portion of the movable guide 72. The auxiliary roller 88 is configured to make contact with the first tape 51 to guide the first tape 51 when the movable guide 72 swings in a direction away from the drum 55 (a counterclockwise direction in FIG. 3).

[Operation of Paper Sheet Storage Device]

Next, the operation performed by the paper sheet storage device 40 will be described. The paper sheet storage device 40 is configured to perform the storage operation of storing the paper sheets sent into the device and the feeding operation of feeding the paper sheets stored in the storage operation.

<Storage Operation>

In the storage operation, the first reel 53 and the second reel 54 rotate in a forward direction (the clockwise direction in FIG. 3). Then, as illustrated in FIG. 6, a paper sheet 100 is sandwiched between the first tape 51 and the second tape 52, and the first tape 51 and the second tape 52 are wound around the drum 55 together with the paper sheet 100. In this state, the first tape 51 is positioned outside the paper sheet 100 (sandwiched between the first tape 51 and the second tape 52) in the radial direction of the drum 55, and the second tape 52 is positioned radially inside the paper sheet. Specifically, an inner side of the first tape 51 (an inner side in the radial direction of the drum 55) makes contact with an outer side of the paper sheet 100 (an outer side in the radial direction of the drum 55), and an outer side of the second tape 52 makes contact with an inner side of the paper sheet 100. In this way, the paper sheet 100 is stored.

Specifically, the paper sheet sent to the inlet/outlet port 400 of the paper sheet storage device 40 is transported from the inlet/outlet port 400 toward the movable guide 72 through the transport path of the fixed guide 71, and is sent to the movable guide 72. The paper sheet sent to the movable guide 72 is transported toward the intermediate roller 87 by the first and second transport belts 73 and 74 through the transport path of the movable guide 72, transported toward the sandwiching portion 80 from the intermediate roller 87 by the first tape 51 running between the intermediate roller 87 and the sandwiching portion 80 (the first transport roller 81), and sandwiched between the first and second tapes 51 and 52 at the sandwiching portion 80. Then, the paper sheet sandwiched between the first and second tapes 51 and 52 at the sandwiching portion 80 is wound around the drum 55 together with the first and second tapes 51 and 52.

<Rotation Control in Storage Operation>

In the storage operation, the drive mechanism 60 controls the rotations of the first reel shaft 61, the second reel shaft 62, and the drum shaft 63 such that the first reel 53, the second reel 54, and the drum 55 rotate in the forward direction (a direction indicated by solid arrows in FIG. 5) with a tension acted on the first tape 51 and the second tape 52.

In this example, the drive mechanism 60 allows the drum shaft 63 to rotate in the forward direction. This causes the drum 55 fixed to the drum shaft 63 to rotate in the forward direction. The drive mechanism 60 does not allow the first and second reel shafts 61 and 62 to rotate so that the first and second reel shafts 61 and 62 are kept in a stopped state. Thus, the first reel 53 fixed to the first reel shaft 61 via the first torque limiter 57 does not rotate, and is kept in a stopped state. Likewise, the second reel 54 fixed to the second reel shaft 62 via the second torque limiter 58 does not rotate, and is kept in a stopped state.

In this way, when the drum 55 rotates in the forward direction with the first and second reels 53 and 54 kept in the stopped state, a tension acts on the first and second tapes 51 and 52 running between the first and second reels 53 and 54 and the drum 55. Further, a torque corresponding to the tension acting on the first and second tapes 51 and 52 acts on the first and second reels 53 and 54.

Then, when the torque acting on the first reel 53 increases to the set torque of the first torque limiter 57 (first set torque) as a result of the increase in the tension acting on the first tape 51, the first torque limiter 57 disconnects the first reel 53 and the first reel shaft 61, so that the first reel 53 can rotate in the forward direction. Likewise, when the torque acting on the second reel 54 increases to the set torque of the second torque limiter 58 (second set torque) as a result of the increase in the tension acting on the second tape 52, the second torque limiter 58 disconnects the second reel 54 and the second reel shaft 62 so that the second reel 54 can rotate in the forward direction.

Under such control, in the storage operation, the tension corresponding to the set torque of the first torque limiter 57 (the first set torque) always acts on the first tape 51, and the tension corresponding to the set torque of the second torque limiter 58 (the second set torque) always acts on the second tape 52.

The drive mechanism 60 may be configured to rotationally drive the first reel shaft 61 and the second reel shaft 62 together with the drum 55 in the storage operation. In this case, the rotations of the drum 55, the first reel shaft 61, and the second reel shaft 62 are controlled such that the speed at which the first reel 53 rewinds the first tape 51 and the speed at which the second reel 54 rewinds the second tape 52 are faster than the speed at which the drum 55 winds the first and second tapes 51 and 52. This allows the tensions corresponding to the first and second set torques to respectively act on the first and second tapes 51 and 52.

<Feeding Operation>

In the feeding operation, the drum 55, the first reel 53, and the second reel 54 rotate in an opposite direction (the counterclockwise direction in FIG. 3). Thus, the first tape 51 is wound around the first reel 53, the second tape 52 is wound around the second reel 54, and the paper sheet 100 sandwiched between the first and second tapes 51 and 52 is fed from the drum 55.

Specifically, before the start of the feeding operation, the paper sheet 100 is sandwiched between the first and second tapes 51 and 52, and the first and second tapes 51 and 52 are wound around the drum 55 together with the paper sheet 100. In this state, the first tape 51 is positioned outside the paper sheet 100 (the paper sheet 100 sandwiched between the first tape 51 and the second tape 52) in the radial direction of the drum 55, and the second tape 52 is positioned radially inside the paper sheet. Specifically, the inner side of the first tape 51 (inner side in the radial direction of the drum 55) makes contact with the outer side of the paper sheet 100 (outer side in the radial direction of the drum 55), and the outer side of the second tape 52 makes contact with the inner side of the paper sheet 100. When the feeding operation is started, the paper sheet sandwiched between the first tape 51 and the second tape 52 and wound around the drum 55 together with the first tape 51 and the second tape 52 is transported to the sandwiching portion 80 provided at the end of the transport path of the movable guide 72 (the end near the drum 55). The paper sheet is released from the sandwiched state between the first tape 51 and the second tape 52 at the sandwiching portion 80. The paper sheet is transported toward the intermediate roller 87 from the sandwiching portion 80 by the first tape 51 running between the sandwiching portion 80 (the first transport roller 81) and the intermediate roller 87. The paper sheet is transported toward the fixed guide 71 from the intermediate roller 87 by the first and second transport belts 73 and 74, and sent to the fixed guide 71. Then, the paper sheet sent to the fixed guide 71 is transported toward the inlet/outlet port 400 from the movable guide 72 through the transport path of the fixed guide 71, and is fed out of the inlet/outlet port 400.

<Rotation Control in Feeding Operation>

In the feeding operation, the drive mechanism 60 controls the rotations of the first reel shaft 61, the second reel shaft 62, and the drum shaft 63 such that the first reel 53, the second reel 54, and the drum 55 rotate in the opposite direction (a direction opposite to the direction indicated by the solid arrows in FIG. 5) with the tension acting on the first tape 51 and the second tape 52.

In this example, the drive mechanism 60 rotates the drum shaft 63 in the opposite direction. This allows the drum 55 fixed to the drum shaft 63 to rotate in the opposite direction. Further, the drive mechanism 60 rotates the first reel shaft 61 and the second reel shaft 62 in the opposite direction. This allows the first reel 53 fixed to the first reel shaft 61 via the first torque limiter 57 to rotate in the opposite direction. Likewise, the second reel 54 fixed to the second reel shaft 62 via the second torque limiter 58 rotates in the opposite direction.

The drive mechanism 60 controls the rotations of the first reel shaft 61, the second reel shaft 62, and the drum shaft 63 such that the tension acts on each of the first and second tapes 51 and 52. For example, the drive mechanism 60 controls the rotations of the first reel shaft 61, the second reel shaft 62, and the drum shaft 63 such that the speed at which the first and second reels 53 and 54 respectively wind (take in) the first and second tapes 51 and 52 is always faster than the speed at which the drum 55 rewinds (feeds) the first and second tapes 51 and 52.

When the torque acting on the first reel 53 increases to the set torque of the first torque limiter 57 (the first set torque) as a result of the increase in the tension acting on the first tape 51, the first torque limiter 57 disconnects the first reel 53 and the first reel shaft 61, so that the first reel 53 slips. Likewise, when the torque acting on the second reel 54 increases to the set torque of the second torque limiter 58 (the second set torque) as a result of the increase in the tension acting on the second tape 52, the second torque limiter 58 disconnects the second reel 54 and the second reel shaft 62, so that the second reel 54 slips.

Under such control, in the feeding operation, the tension corresponding to the set torque of the first torque limiter 57 (the first set torque) always acts on the first tape 51, and the tension corresponding to the set torque of the second torque limiter 58 (the second set torque) always acts on the second tape 52.

[Tension Acting on Tape]

In the paper sheet storage device 40, the tension acting on the first tape 51 in the storage operation is greater than that acting on the second tape 52 in the storage operation. Likewise, the tension acting on the first tape 51 in the feeding operation is greater than that acting on the second tape 52 in the feeding operation. For example, the tension acting on the first tape 51 is in the range of 110% to 130% of the tension acting on the second tape 52. In more detail, with reference to FIG. 5, in both of the storage operation and the feeding operation in this example, the first tape 51*a* receives a greater tension than the second tape 52*a*, and the first tape 51*b* receives a greater tension than the second tape 52*b*.

In this example, the maximum torque of the first reel 53 regulated by the first torque limiter 57 is greater than that of the second reel 54 regulated by the second torque limiter 58. Specifically, the set torque of the first torque limiter 57 (the first set torque) is greater than the set torque of the second torque limiter 58 (the second set torque). In more detail, with reference to FIG. 5, the set torque of the first torque limiter 57*a* is greater than that of the second torque limiter 58*a*, and the set torque of the first torque limiter 57*b* is greater than that of the second torque limiter 58*b*.

As the torque acting on the first reel 53 increases, the tension acting on the first tape 51 tends to increase. Likewise, as the torque acting on the second reel 54 increases, the tension acting on the second tape 52 tends to increase. Consequently, when the maximum torque of the first reel 53 is made greater than that of the second reel 54, the tension acting on the first tape 51 can be made greater than that acting on the second tape 52.

[Advantages of Embodiment]

As can be seen, the tension acting on the first tape 51 in the storage operation is made greater than that acting on the second tape 52 in the storage operation. Thus, when the first tape 51 and the second tape 52 are wound around the drum 55 with the paper sheet sandwiched therebetween, the first tape 51 positioned outside the paper sheet in the radial direction of the drum 55 can be tightly wound around the drum 55. This can make the first tape 51 less loosened in the storage operation, and can reduce the deterioration of the winding state of the paper sheet on the drum 55.

Further, the tension acting on the first tape 51 in the feeding operation is made greater than that acting on the second tape 52 in the feeding operation. This can make the first tape 51 less loosened in the feeding operation, and can reduce the deterioration of the winding state of the paper sheet on the drum 55.

In addition, since the deterioration of the winding state of the paper sheet on the drum 55 can be reduced, the frequency of pause of the paper sheet handling machine 10 caused by a winding failure of the paper sheet in the paper sheet storage device 40 can be reduced.

[Abutting Member]

As illustrated in FIG. 3 and FIG. 4, in this example, an abutting member 43 is provided in the housing 41. The abutting member 43 is configured to make contact with the tip end portion of the movable guide 72 biased in the direction approaching the drum 55 (the clockwise direction in FIG. 3) when the apparent diameter of the drum 55 is smaller than a predetermined diameter, thereby regulating the swing of the movable guide 72 (swing in the direction approaching the drum 55). When the apparent diameter of the drum 55 is smaller than the predetermined diameter, the abutting member 43 configured in this manner can avoid contact between the pressing roller 75 provided at the tip end portion of the movable guide 72 and the tape (the first tape 51 in this example) wound around the drum 55.

When the first tape 51 and the second tape 52 wound around the drum 55 are pressed by the pressing roller 75 in a situation where the number of paper sheets wound around the drum 55 is relatively small (that is, when the apparent diameter of the drum 55 is relatively small), the first and second tapes 51 and 52 may possibly be misaligned with each other due to variation in parts or assembly of the pressing roller 75 and the movable guide 72. In a situation where the number of paper sheets wound around the drum 55 is relatively large (that is, when the apparent diameter of the drum 55 is relatively large), the misalignment of the first tape 51 and the second tape 52 caused by the variation in parts and assembly of the pressing roller 75 and the movable guide 72 is reduced by friction of the paper sheets wound around the drum 55 together with the first tape 51 and the second tape 52.

Consequently, when the apparent diameter of the drum 55 is smaller than the predetermined diameter, the pressing roller 75 provided at the tip end portion of the movable guide 72 is blocked from making contact with the tape (the first tape 51 in this example) wound around the drum 55. This can prevent the misalignment of the first tape 51 and the second tape 52 caused by the variation in parts and assembly of the pressing roller 75 and the movable guide 72.

[Regulating Wall]

Figure 7:
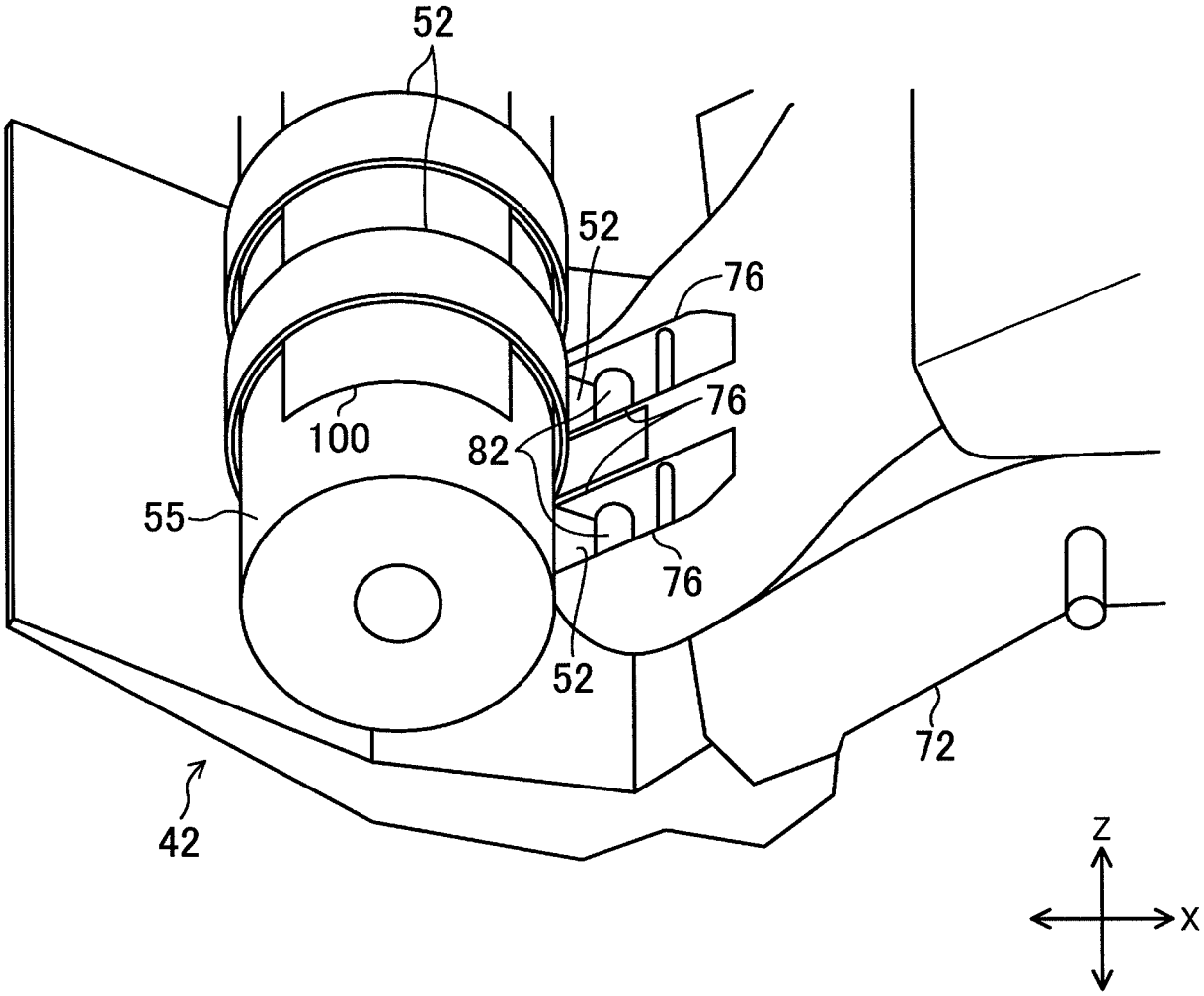
FIG. 7 is a schematic perspective view illustrating a major part of the paper sheet storage device.

As illustrated in FIG. 3 and FIG. 7, in this example, the movable guide 72 is provided with regulating walls 76. As illustrated in FIG. 7, the regulating walls 76 are disposed at both sides in a width direction of the second tape 52, and are configured to make contact with the second tape 52 when the traveling position of the second tape 52 is shifted in the width direction. The regulating walls 76 configured in this manner can regulate the shift of the traveling position of the second tape 52 (shift in the width direction).

First Modification of Paper Sheet Storage Device

Figure 8:
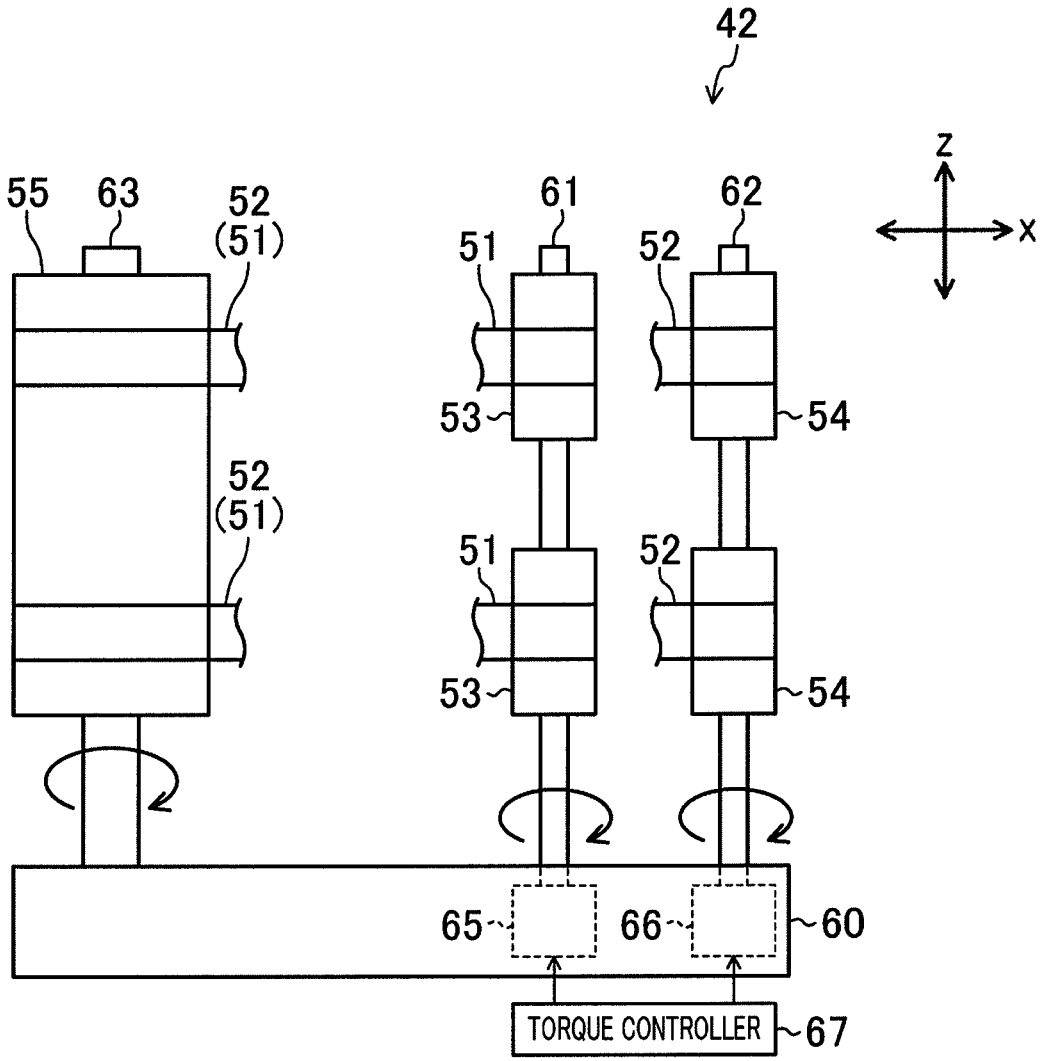
FIG. 8 is a schematic plan view illustrating a first modification of the paper sheet storage device.

As illustrated in FIG. 8, the drive mechanism 60 may have a first driver 65 and a second driver 66 respectively corresponding to the first reel 53 and the second reel 54. In the first modification, the paper sheet storage device is not provided with the first and second torque limiters 57 and 58 illustrated in FIG. 5. The first reel 53 is fixed to the first reel shaft 61, and is configured to be rotationally driven together with the first reel shaft 61. The second reel 54 is fixed to the second reel shaft 62, and configured to be rotationally driven together with the second reel shaft 62. The paper sheet storage device 40 further includes a torque controller 67. Other configurations of the paper sheet storage device 40 illustrated in FIG. 8 are the same as those of the paper sheet storage device 40 illustrated in FIG. 3 to FIG. 7.

[Driver]

The first driver 65 is configured to rotationally drive the first reel shaft 61, thereby rotating the first reel 53. The second driver 66 is configured to rotationally drive the second reel shaft 62, thereby rotating the second reel 54. For example, each of the first and second drivers 65 and 66 may be a motor.

[Torque Controller]

The torque controller 67 is configured to control the torque acting on the first reel 53 and the torque acting on the second reel 54. Specifically, in at least one of the storage operation or the feeding operation, the torque controller 67 is configured to control the first and second drivers 65 and 66 such that the torque acting on the first reel 53 when the first driver 65 rotationally drives the first reel 53 is greater than the torque acting on the second reel 54 when the second driver 66 rotationally drives the second reel 54. For example, the torque controller 67 includes a processing unit such as a CPU, and a storage unit such as a memory for storing a program and information for operating the processing unit. The torque controller 67 may be part of the controller 11 illustrated in FIG. 2.

[Advantages of First Modification of Paper Sheet Storage Device]

As described above, controlling the first and second drivers 65 and 66 can make the tension acting on the first tape 51 greater than that acting on the second tape 52 in the storage operation (or the feeding operation). Thus, the first tape 51 can be wound more tightly around the drum 55 than the second tape 52, thereby making the first tape 51 less loosened in the storage operation (or the feeding operation). This can reduce the deterioration of the winding state of the paper sheets on the drum 55.

Further, since the torque acting on the first reel 53 and the torque acting on the second reel 54 can be easily regulated by electrical control, the torques can be set to an appropriate level.

The drive mechanism 60 may have a drum driver (not illustrated) which rotationally drives the drum shaft 63, thereby rotating the drum 55. The torque controller 67 may be configured to control the torque acting on the drum shaft 63 by controlling the drum driver. In this configuration, the torque acting on each of the first reel 53, the second reel 54, and the drum shaft 63 can be controlled to regulate the tension acting on each of the first tape 51 and the second tape 52.

Second Modification of Paper Sheet Storage Device

Figure 9:
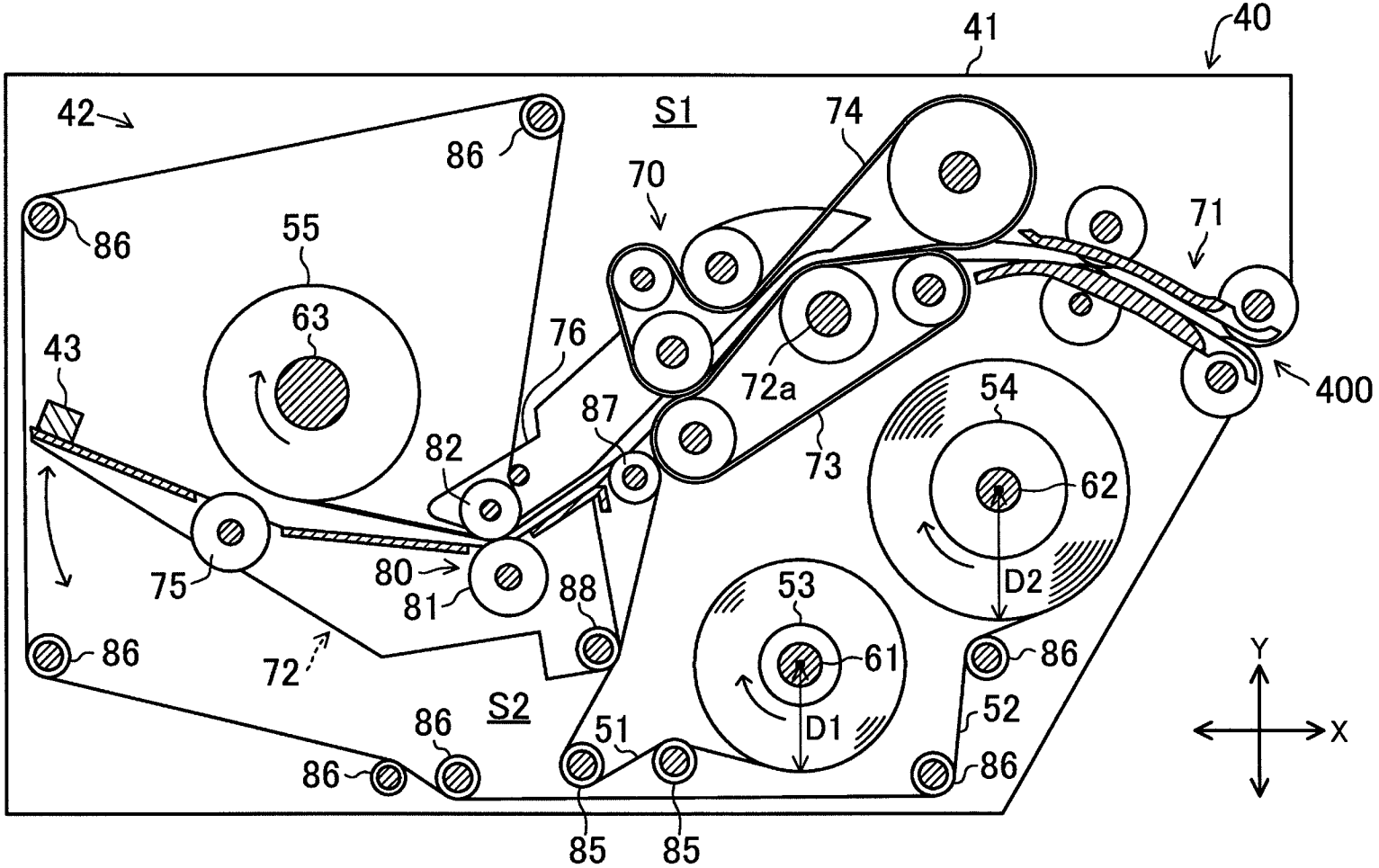
FIG. 9 is a schematic sectional view illustrating a second modification of the paper sheet storage device.

As illustrated in FIG. 9, a winding diameter D1 of the first tape 51 on the first reel 53 may be smaller than a winding diameter D2 of the second tape 52 on the second reel 54. In the paper sheet storage device of the second modification illustrated in FIG. 9, the diameter of the first reel 53 is smaller than that of the second reel 54, and the maximum torque of the first reel 53 regulated by the first torque limiter 57 is identical to that of the second reel 54 regulated by the second torque limiter 58. Other configurations of the paper sheet storage device 40 illustrated in FIG. 9 are the same as those of the paper sheet storage device 40 illustrated in FIG. 3 to FIG. 7.

As the winding diameter D1 of the first tape 51 in the first reel 53 decreases, the tension acting on the first tape 51 tends to increase. Likewise, as the winding diameter D2 of the second tape 52 on the second reel 54 decreases, the tension acting on the second tape 52 tends to increase. Consequently, when the winding diameter D1 of the first tape 51 on the first reel 53 is made smaller than the winding diameter D2 of the second tape 52 on the second reel 54, the tension acting on the first tape 51 can be made greater than that acting on the second tape 52. This can make the first tape 51 less loosened in the storage operation (or the feeding operation), thereby reducing the deterioration of the winding state of the paper sheet on the drum 55.

In the example of FIG. 9, the maximum torque of the first reel 53 regulated by the first torque limiter 57 (i.e., the first set torque) may be different from, or greater than, the maximum torque of the second reel 54 regulated by the second torque limiter 58 (i.e., the second set torque). Specifically, the maximum torque of the first reel 53 regulated by the first torque limiter 57, the maximum torque of the second reel 54 regulated by the second torque limiter 58, the winding diameter D1 of the first tape 51 on the first reel 53, and the winding diameter D2 of the second tape 52 on the second reel 54 may be determined such that the tension acting on the first tape 51 in the storage operation (or the feeding operation) is greater than the tension acting on the second tape 52 in the storage operation (or the feeding operation).

Third Modification of Paper Sheet Storage Device

Figure 10:
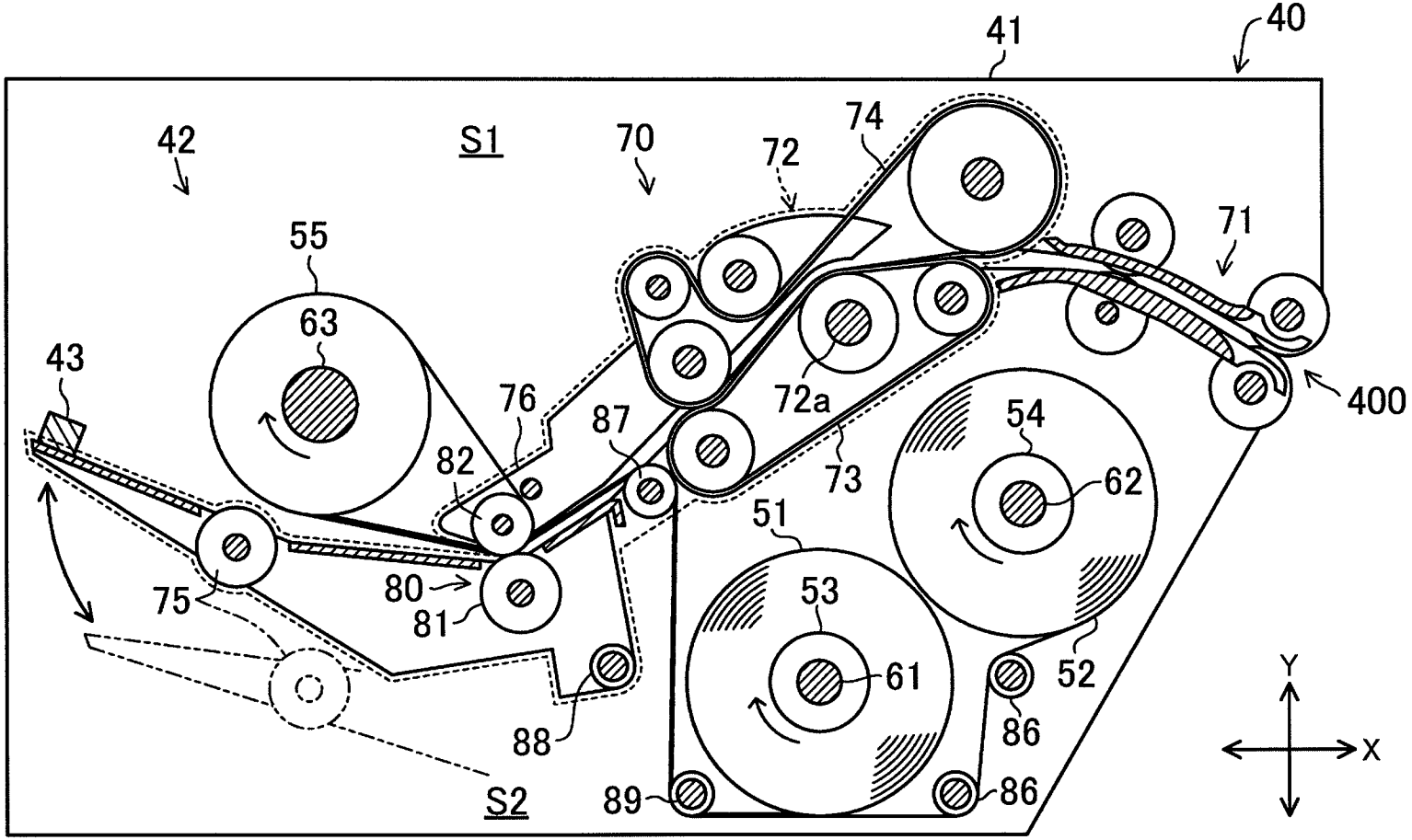
FIG. 10 is a schematic sectional view illustrating a third modification of the paper sheet storage device.
Figure 11:
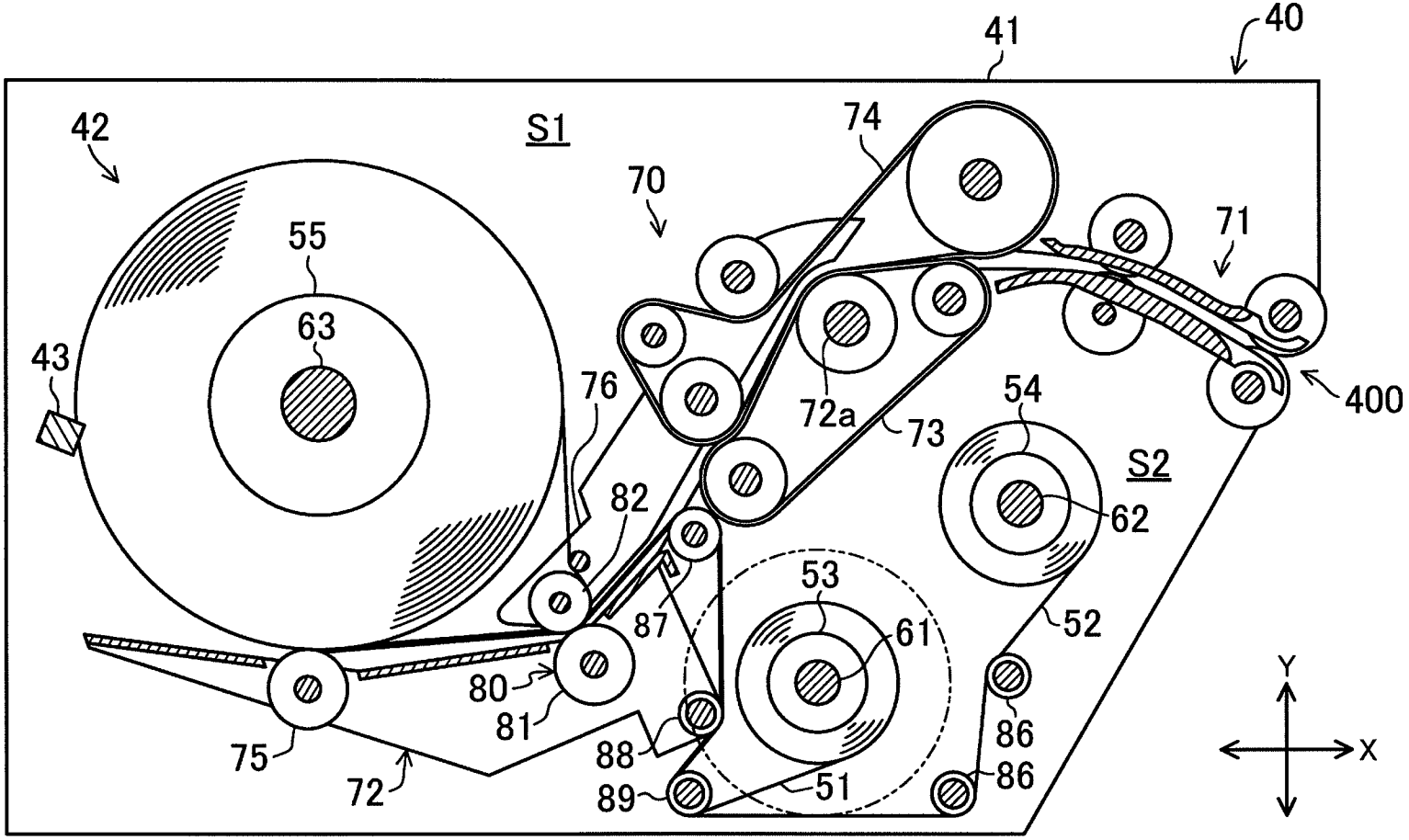
FIG. 11 is a schematic sectional view illustrating the third modification of the paper sheet storage device.

As illustrated in FIG. 10, the first and second tapes 51 and 52 may run between the first and second reels 53 and 54 and the sandwiching portion 80 such that the paths from the first and second reels 53 and 54 to the drum 55 partially overlap with each other. With reference to FIG. 10 to FIG. 13, the third modification of the paper sheet storage device will be described below.

In the third modification, the storage mechanism 42 may have a common roller 89 instead of some of the plurality of first guide rollers 85 and the plurality of second guide rollers 86. The common roller 89 is disposed in the first space S1, and is configured to guide the first and second tapes 51 and 52 between the first and second reels 53 and 54 and the sandwiching portion 80. That is, in this example, the first tape 51 sequentially passes through the common roller 89, the intermediate roller 87, and the sandwiching portion 80 before reaching the drum 55. The second tape 52 sequentially passes through the plurality of second guide rollers 86, the common roller 89, the intermediate roller 87, and the sandwiching portion 80 before reaching the drum 55. In this way, the path of the first tape 51 from the first reel 53 to the drum 55 and the path of the second tape 52 from the second reel 54 to the drum 55 overlap with each other in a path from the common roller 89 to the drum 55 via the intermediate roller 87 and the sandwiching portion 80.

Figure 12:
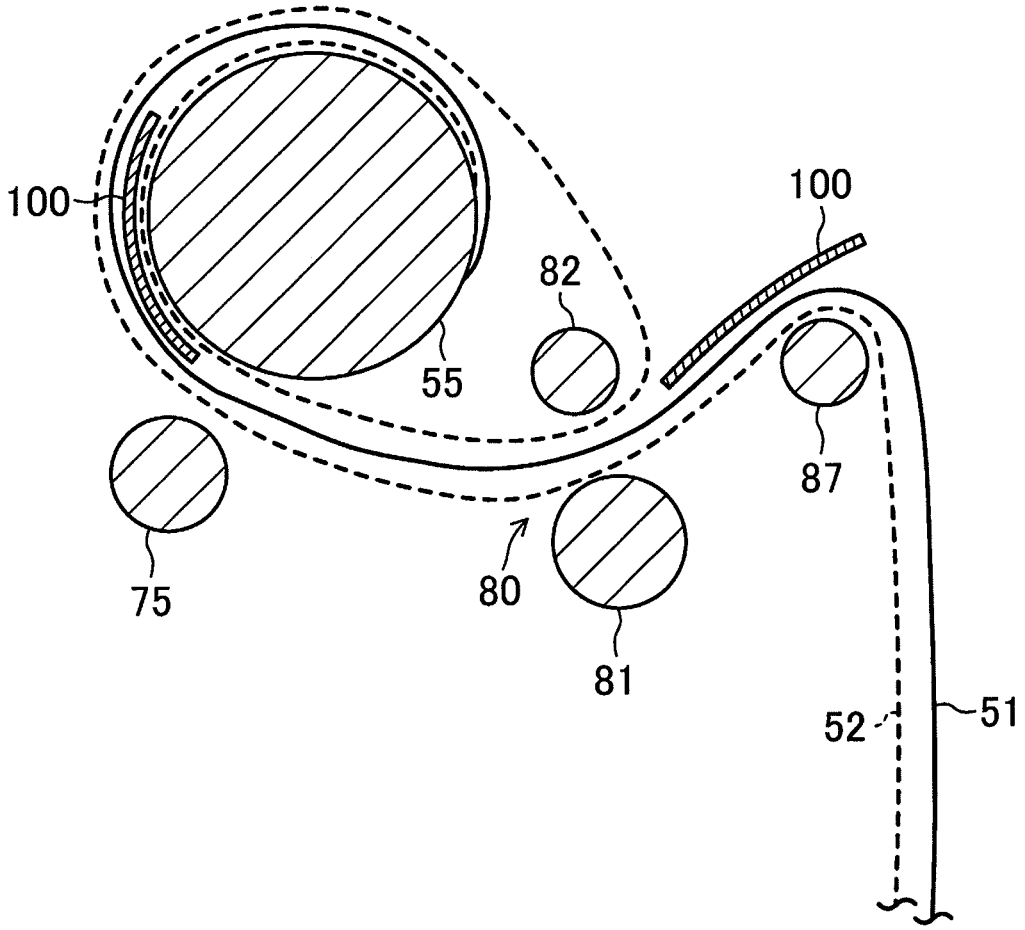
FIG. 12 is a conceptual view illustrating a major part of the third modification of the paper sheet storage device.
Figure 13:
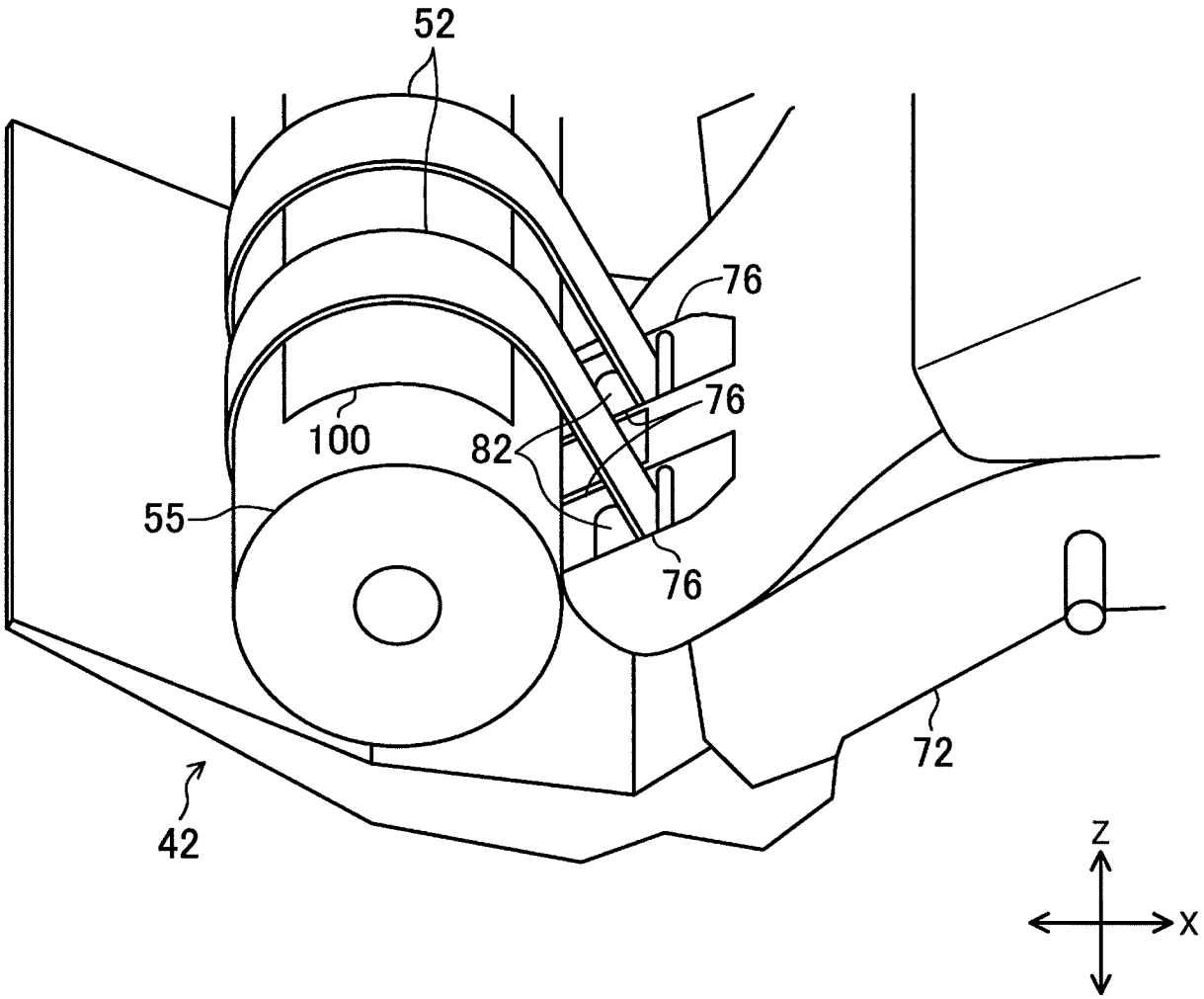
FIG. 13 is a schematic perspective view illustrating a major part of the third modification of the paper sheet storage device.

As illustrated in FIG. 12, the first tape 51 is wound around the drum 55 after passing through the sandwiching portion 80. On the other hand, the second tape 52 is wound along the outer peripheral surface of the drum 55 after passing through the sandwiching portion 80, separated from the outer peripheral surface of the drum 55 to be wound around the second transport roller 82, and then wound around the drum 55.

Other configurations of the paper sheet storage device 40 illustrated in FIG. 10 to FIG. 13 are the same as those of the paper sheet storage device 40 illustrated in FIG. 3 to FIG. 7.

Fourth Modification of Paper Sheet Storage Device

Figure 14:
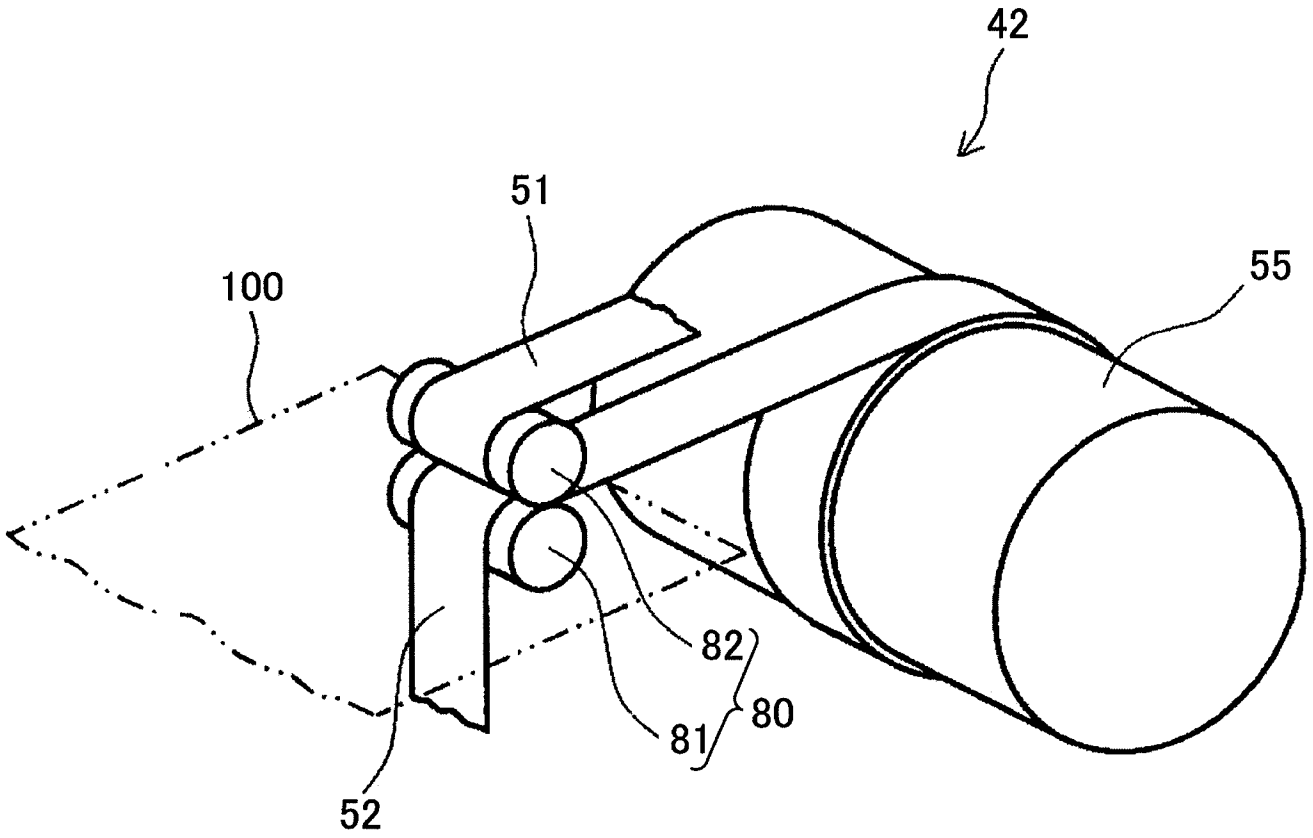
FIG. 14 is a schematic perspective view illustrating a fourth modification of the paper sheet storage device.

As illustrated in FIG. 14, the paper sheet storage device 40 may include a single first tape 51 and a single second tape 52. In the example of FIG. 14, the paper sheet storage device 40 includes a single first reel 53 (not illustrated) and a single second reel 54 (not illustrated) respectively corresponding to the single first tape 51 and the single second tape 52, the drum 55, a single first torque limiter 57 (not illustrated) corresponding to the first reel 53, and a single second torque limiter 58 (not illustrated) corresponding to the second reel 54. Other configurations of the paper sheet storage device 40 illustrated in FIG. 14 are the same as those of the paper sheet storage device 40 illustrated in FIG. 3 to FIG. 7.

Fifth Modification of Paper Sheet Storage Device

Figure 15:
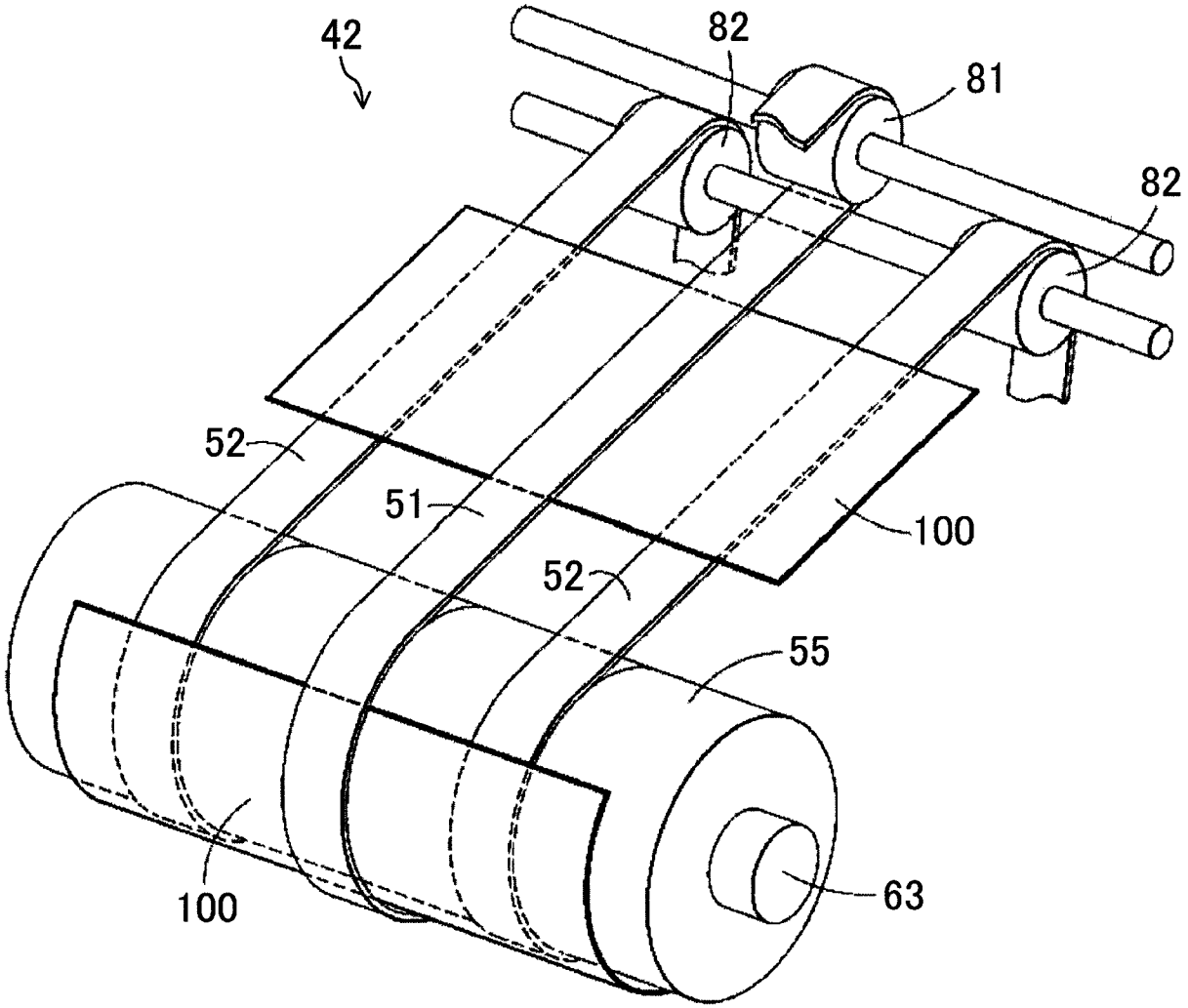
FIG. 15 is a schematic perspective view illustrating a fifth modification of the paper sheet storage device.

As illustrated in FIG. 15, the number of first tapes 51 and the number of second tapes 52 may be different from each other. In the example of FIG. 15, the paper sheet storage device 40 includes a single first tape 51, two second tapes 52, a single first reel 53 (not illustrated) and two second reels 54 (not illustrated) respectively corresponding to the single first tape 51 and the two second tapes 52, the drum 55, a single first torque limiter 57 (not illustrated) corresponding to the single first reel 53, and two second torque limiters 58 (not illustrated) corresponding to the two second reels 54. Other configurations of the paper sheet storage device 40 illustrated in FIG. 15 are the same as those of the paper sheet storage device 40 illustrated in FIG. 3 to FIG. 7.

In the example of FIG. 15, the first tape 51 and the second tapes 52 are wound around the drum 55 not to overlap with each other in the radial direction of the drum 55. That is, in the example of FIG. 15, the position of the first tape 51 in the axial direction of the drum 55 is different from the positions of the second tapes 52 in the axial direction of the drum 55.

Also in the third to fifth modifications of the paper sheet storage device described above, the first tape 51 is positioned outside the paper sheet wound around the drum 55 (the paper sheet sandwiched between the first and second tapes 51 and 52) in the radial direction of the drum 55, and the second tape 52 is positioned radially inside the paper sheet. The tension acting on the first tape 51 is made greater than the tension acting on the second tape 52 in at least one of the storage operation or the feeding operation, so that the first tape 51 can be wound more tightly around the drum 55 than the second tape 52. This can make the first tape 51 less loosened in the storage operation (or the feeding operation), thereby reducing the deterioration of the winding state of the paper sheet on the drum 55.

First Modification of First and Second Tapes

Figure 16:
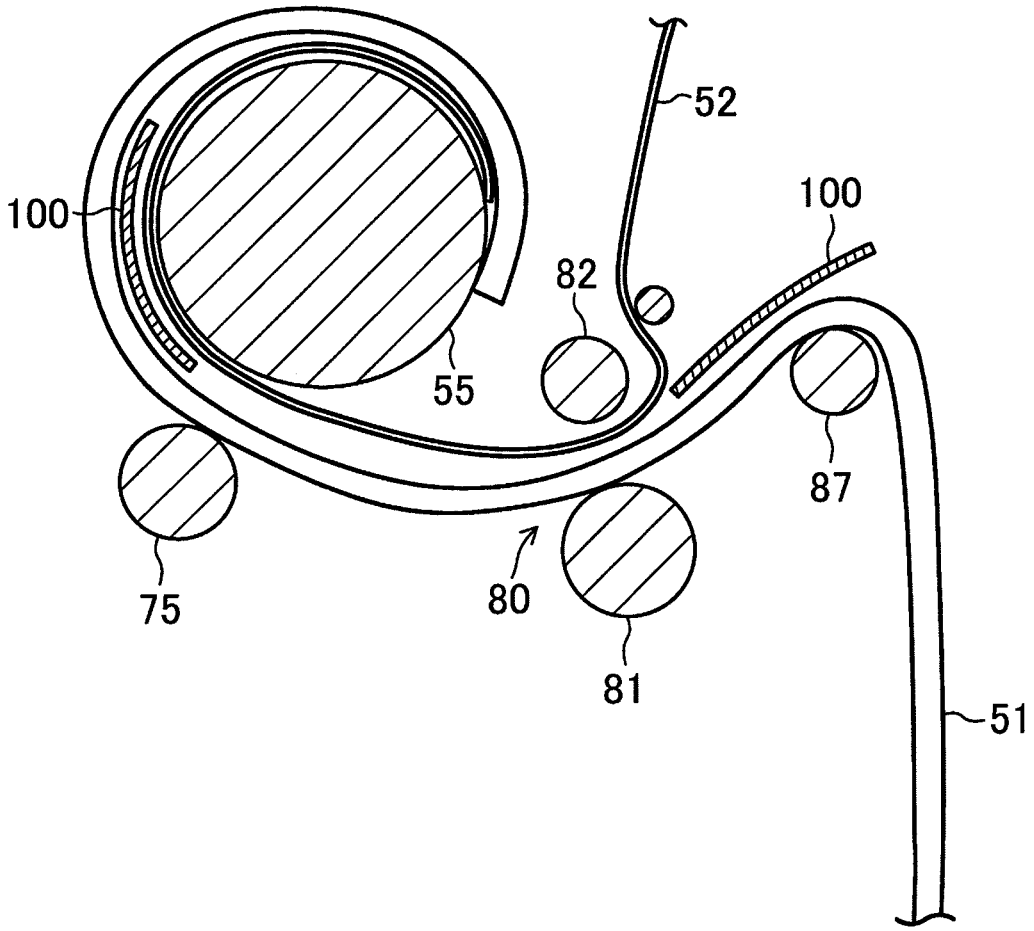
FIG. 16 is a conceptual view illustrating a first modification of first and second tapes.

As illustrated in FIG. 16, the first tape 51 may be thicker than the second tape 52. For example, the first tape 51 may be made of a laminate of a plurality of tapes (e.g., a tape serving as the second tape 52).

With the first tape 51 made thicker than the second tape 52, the first tape 51 can be improved in durability against the tension. This can reduce the deterioration of the tape 51 due to the tension.

In addition, this can improve the strength of the first tape 51 against reaction force of the paper sheet sandwiched between the first tape 51 and the second tape 52, and the paper sheet can be tightly wound around the drum 55 by the first tape 51. Thus, the deterioration of the winding state of the paper sheet on the drum 55 can be reduced.

Furthermore, making the second tape 52 thinner than the first tape 51 can reduce the apparent radius of the drum 55. This can reduce a space required for storing the drum 55, or increase the number of paper sheets that can be stored in the paper sheet storage device 40.

Second Modification of First and Second Tapes

Figure 17:
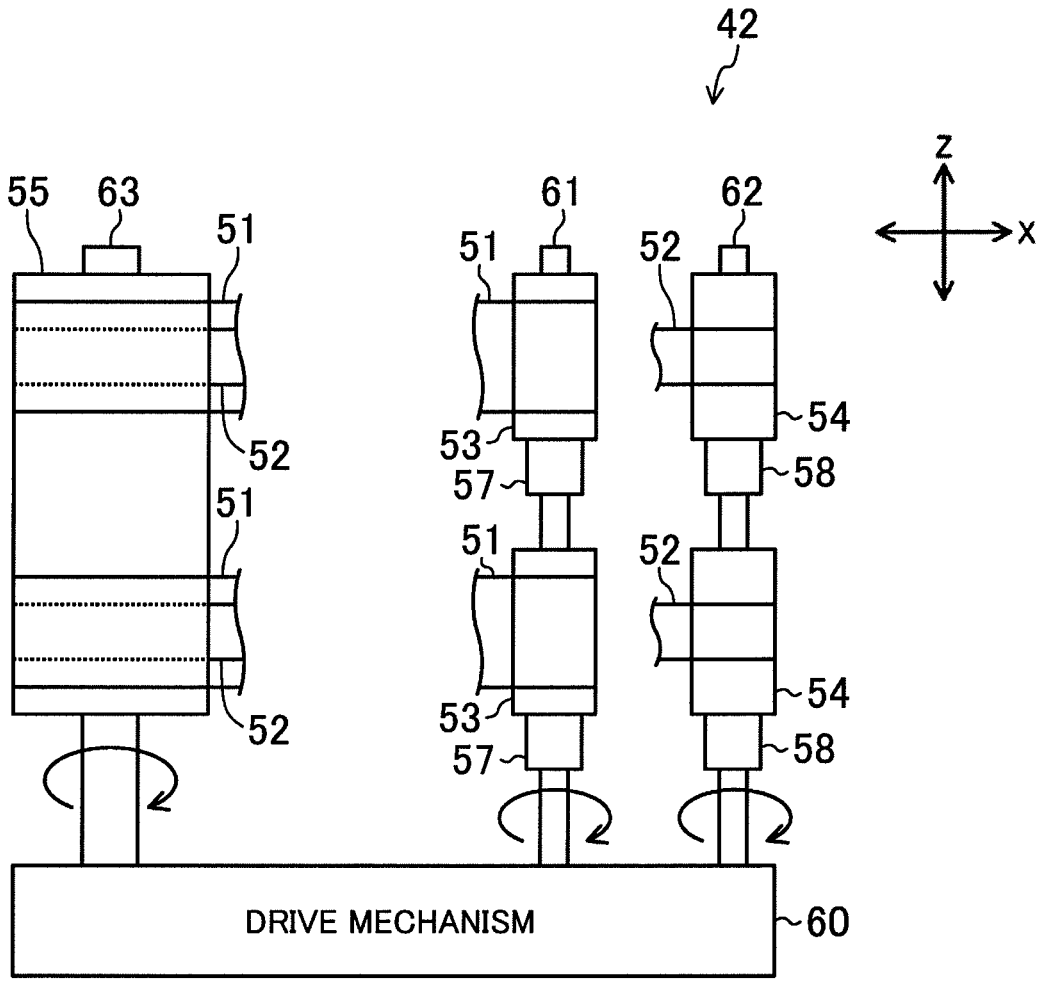
FIG. 17 is a schematic plan view illustrating a second modification of the first and second tapes.

As illustrated in FIG. 17, the first tape 51 may be wider than the second tape 52.

With the first tape 51 made wider than the second tape 52, the first tape 51 can be improved in durability against the tension. This can reduce the deterioration of the first tape 51 due to the tension.

In addition, this can increase the contact area between the first tape 51 and the paper sheet, so that the paper sheet can be tightly wound around the drum 55 by the first tape 51. Thus, the deterioration of the winding state of the paper sheet on the drum 55 can be reduced.

Third Modification of First and Second Tapes

The first tape 51 may have higher rigidity than the second tape 52.

The first tape 51 having higher rigidity than the second tape 52 can improve the first tape 51 in durability against the tension. This can reduce the deterioration of the first tape 51 due to the tension.

In addition, this can improve the strength of the first tape 51 against the reaction force of the paper sheet sandwiched between the first tape 51 and the second tape 52, so that the paper sheet can be tightly wound around the drum 55 by the first tape 51. This can reduce the deterioration of the winding state of the paper sheet in the drum 55.

Fourth Modification of First and Second Tapes

Figure 18:
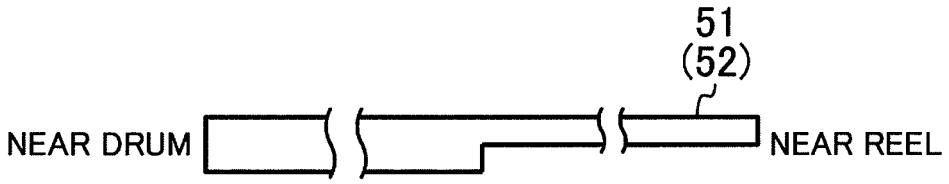
FIG. 18 is a schematic sectional view illustrating a fourth modification of the first and second tapes.

As illustrated in FIG. 18, a portion of the first tape 51 near the drum 55 may be thicker than a portion of the first tape 51 near the first reel 53. Likewise, a portion of the second tape 52 near the drum 55 may be thicker than a portion of the second tape 52 near the second reel 54. Specifically, a portion of the first tape 51 (or the second tape 52) of a predetermined length from its end fixed to the drum 55 may be thicker than the remaining portion of the first tape 51 (or the second tape 52). FIG. 18 illustrates a cross section taken along the longitudinal direction and the thickness direction of the first tape 51 (or the second tape 52).

The first tape 51, the second tape 52, and the paper sheet which are wound around the drum 55 gradually decrease in radius of curvature toward the center of the drum 55. Thus, it becomes more difficult to wind the paper sheet by the first tape 51 and the second tape 52 (particularly, the first tape 51) as the distance to the center of the drum 55 decreases.

Consequently, when the first tape 51 whose portion near the drum 55 is made thicker than a portion near the first reel 53 is wound around the drum 55, a portion of the first tape 51 closer to the center of the drum 55 can be thicker. This can improve the strength of the first tape 51 against the reaction force of the paper sheet sandwiched between the first tape 51 and the second tape 52, so that the paper sheet can be tightly wound around the drum 55 by the first tape 51. Thus, the deterioration of the winding state of the paper sheet on the drum 55 can be reduced.

Also, when the second tape 52 whose portion near the drum 55 is made thicker than a portion near the second reel 54 is wound around the drum 55, a portion of the second tape 52 closer to the center of the drum 55 can be thicker. This can improve the strength of the second tape 52 against the reaction force of the paper sheet sandwiched between the first tape 51 and the second tape 52, so that the paper sheet can be curved along the second tape 52 by the second tape 52. Thus, the deterioration of the winding state of the paper sheet on the drum 55 can be reduced.

Further, when the first reel 53, to which one end of the first tape 51 has been connected, is stored outside the paper sheet storage device 40, the first tape 51 is wound around the first reel 53. In this case, the portion of the first tape 51 near the drum 55 forms outer turns of the first tape 51 wound around the first reel 53. Consequently, with the portion of the first tape 51 near the drum 55 made thicker than the portion of the first tape 51 near the first reel 53, the outer turns of the first tape 51 wound around the first reel 53 can be made thicker. This can improve durability of the outer turns of the first tape 51 wound around the first reel 53 against scratches.

Likewise, when the second reel 54, to which one end of the second tape 52 has been connected, is stored outside the paper sheet storage device 40, the second tape 52 is wound around the second reel 54. In this case, a portion of the second tape 52 near the drum 55 forms outer turns of the second tape 52 wound around the second reel 54. Consequently, with the portion of the second tape 52 near the drum 55 made thicker than the portion of the second tape 52 near the second reel 54, the outer turns of the second tape 52 wound around the second reel 54 can be made thicker. This can improve durability of the outer turns of the second tape 52 wound around the second reel 54 against scratches.

When the paper sheet storage device 40 is used as the temporary storage 24, it may be repeated that some banknotes (an example of the paper sheets) are temporarily stored in the paper sheet storage device 40, and then some of the temporarily stored banknotes are fed from the paper sheet storage device 40. In such a case, the portion of the first tape 51 near the drum 55 tends to be used more frequently than the portion of the first tape 51 near the first reel 53. Likewise, the portion of the second tape 52 near the drum 55 tends to be used more frequently than the portion of the second tape 52 near the second reel 54.

Thus, when the paper sheet storage device 40 is used as the temporary storage 24 (that is, the temporary storage 24 in which some banknotes are temporarily stored and fed in a repeated manner), the portion of the first tape 51 near the drum 55 is made thicker than the portion of the first tape 51 near the first reel 53, so that the portion of the first tape 51 which is used with a relatively high frequency can be made thicker. This can improve durability of the portion of the first tape 51 used with a relatively high frequency against abrasion, and can reduce the deterioration of the first tape 51 due to the abrasion.

Likewise, when the paper sheet storage device 40 is used as the temporary storage 24, the portion of the second tape 52 near the drum 55 is made thicker than the portion of the second tape 52 near the second reel 54, so that the portion of the second tape 52 which is used with a relatively high frequency can be made thicker. This can improve durability of the portion of the second tape 52 used with a relatively high frequency against abrasion, and can reduce the deterioration of the second tape 52 due to the abrasion.

Fifth Modification of First and Second Tapes

Figure 19:
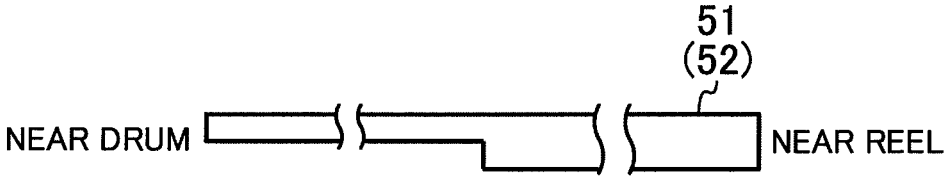
FIG. 19 is a schematic sectional view illustrating a fifth modification of the first and second tapes.

As illustrated in FIG. 19, the portion of the first tape 51 near the first reel 53 may be thicker than the portion of the first tape 51 near the drum 55. Likewise, the portion of the second tape 52 near the second reel 54 may be thicker than the portion of the second tape 52 near the drum 55. Specifically, a portion of the first tape 51 (or the second tape 52) of a predetermined length from its end fixed to the first reel 53 (or the second reel 54) may be thicker than the remaining portion of the first tape 51 (or the second tape 52). FIG. 19 illustrates the cross section taken along the longitudinal direction and the thickness direction of the first tape 51 (or the second tape 52).

When the paper sheet storage device 40 is used as the storage 32, it may be repeated that some banknotes are fed from the paper sheet storage device 40, and then some other banknotes are stored in the paper sheet storage device 40 to keep the paper sheet storage device 40 full (or almost full). In such a case, the portion of the first tape 51 near the first reel 53 tends to be used more frequently than the portion of the first tape 51 near the drum 55. Likewise, the portion of the second tape 52 near the second reel 54 tends to be used more frequently than the portion of the second tape 52 near the drum 55.

Thus, when the paper sheet storage device 40 is used as the storage 32 (that is, the storage 32 in which some banknotes are fed and then some other banknotes are stored such that the full state is kept), the portion of the first tape 51 near the first reel 53 is made thicker than the portion of the first tape 51 near the drum 55, so that the portion of the first tape 51 which is used with a relatively high frequency can be made thicker. This can improve durability of the portion of the first tape 51 used with a relatively high frequency against abrasion, and can reduce the deterioration of the first tape 51 due to the abrasion.

Likewise, when the paper sheet storage device 40 is used as the storage 32, the portion of the second tape 52 near the second reel 54 is made thicker than the portion of the second tape 52 near the drum 55, so that the portion of the second tape 52 with a relatively high frequency can be made thicker. This can improve durability of the portion of the second tape 52 used with a relatively high frequency against abrasion, and can reduce the deterioration of the second tape 52 due to the abrasion.

Sixth Modification of First and Second Tapes

Figure 20:
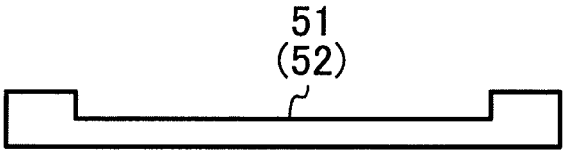
FIG. 20 is a schematic sectional view illustrating a sixth modification of the first and second tapes.

As illustrated in FIG. 20, both edge portions in the width direction of the first tape 51 may be thicker than the center portion in the width direction of the first tape 51. Likewise, both edge portions in the width direction of the second tape 52 may be thicker than the center portion in the width direction of the second tape 52. FIG. 20 illustrates a cross section taken along the width direction and the thickness direction of the first tape 51 (or the second tape 52).

When regulating members are disposed at both sides in the width direction of the first tape 51 to regulate the shift of the traveling position of the first tape 51 (shift in the width direction), the edge portions in the width direction of the first tape 51 are worn by the regulating members. In such a case, the edge portions in the width direction of the first tape 51 are made thicker than the center portion in the width direction of the first tape 51, so that portions of the first tape 51 which make contact with the regulating members can be made thicker. This can improve durability of the portions of the first tape 51 which make contact with the regulating members against abrasion.

Likewise, when regulating members (e.g., the regulating walls 76) are disposed at both sides in the width direction of the second tape 52 to regulate the shift of the traveling position of the second tape 52 (shift in the width direction), the edge portions in the width direction of the second tape 52 are worn by the regulating members. In such a case, the edge portions in the width direction of the second tape 52 are made thicker than the center portion in the width direction of the second tape 52, so that the portions of the second tape 52 which make contact with the regulating members can be made thicker. This can improve durability of the portions of the second tape 52 which make contact with the regulating members against abrasion.

Other Modifications of First and Second Tapes

As described above, the first tape 51 may have a uniform (identical) thickness in the extension direction thereof, or may have a thickness that varies in the extension direction thereof. Likewise, the second tape 52 may have a uniform (identical) thickness in the extension direction thereof, or may have a thickness that varies in the extension direction thereof.

Further, the first tape 51 may have a uniform (identical) thickness in the width direction, or may have a thickness that varies in the width direction. Likewise, the second tape 52 may have a uniform (identical) thickness in the width direction, or may have a thickness that varies in the width direction.

The first tape 51 may have a portion used with a relatively high frequency thickened, or a portion making contact with the regulating member thickened. Likewise, the second tape 52 may have a portion used with a relatively high frequency thickened, or a portion making contact with the regulating member thickened.

Other Embodiments

In the above description, it has been described as an example the case where banknotes (an example of the paper sheets) are transported with their short edges coincide with the transport direction in the paper sheet handling machine 10 and the paper sheet storage device 40. However, in the paper sheet handling machine 10 and the paper sheet storage device 40, the banknotes may be transported with their long edges coincide with the transport direction.

Further, in the above description, it has been described as an example the case where the paper sheet handling machine 10 serves as a banknote handling machine that handles banknotes. However, the present disclosure is not limited thereto, and the paper sheet handling machine 10 may serve as, for example, a valuable medium handling machine that handles a valuable medium (an example of the paper sheet) such as a voucher and a check. Likewise, it has been described as an example the case where the paper sheet storage device 40 is configured to store and feed banknotes. However, the present disclosure is not limited thereto. For example, the paper sheet storage device 40 may be configured to store and feed the valuable medium (an example of the paper sheet) such as a voucher and a check.

The paper sheet may be principally made of paper, or a sheet-like medium principally made of resin.

The embodiments and modifications described above may be combined as appropriate. Note that the embodiments and modifications are essentially preferred examples and are not intended to limit the scope, applications, or use thereof.

As can be seen, the present disclosure is useful as a paper sheet storage device.

What is claimed is:

1. A paper sheet storage device performing a storage operation of storing a paper sheet sent into the device and a feeding operation of feeding the paper sheet, the paper sheet storage device comprising:

a first tape;

a second tape;

a first reel configured to wind the first tape from one end of the first tape;

a second reel configured to wind the second tape from one end of the second tape; and a drum configured to wind the first tape and the second tape from other ends of the first tape and the second tape, wherein in the storage operation, the first tape and the second tape are wound around the drum with the paper sheet sandwiched therebetween to store the paper sheet, the first tape being positioned outside the paper sheet in a radial direction of the drum, in the feeding operation, the first tape is wound around the first reel and the second tape is wound around the second reel to feed the paper sheet from the drum, and in at least one of the storage operation or the feeding operation, greater tension acts on the first tape than on the second tape.

2. The paper sheet storage device of claim 1, further comprising:

a torque controller configured to control a torque acting on the first reel and a torque acting on the second reel.

3. The paper sheet storage device of claim 2, wherein the torque controller includes a first torque limiter which regulates the torque acting on the first reel and a second torque limiter which regulates the torque acting on the second reel, and a maximum torque of the first reel regulated by the first torque limiter is greater than a maximum torque of the second reel regulated by the second torque limiter.

4. The paper sheet storage device of claim 2, further comprising:

a first driver configured to rotationally drive the first reel; and a second driver configured to rotationally drive the second reel, wherein in at least one of the storage operation or the feeding operation, the torque controller controls the first driver and the second driver such that the torque acting on the first reel when the first driver rotationally drives the first reel is greater than the torque acting on the second reel when the second driver rotationally drives the second reel.

5. The paper sheet storage device of claim 1, wherein a winding diameter of the first tape on the first reel is smaller than a winding diameter of the second tape on the second reel.

6. The paper sheet storage device of claim 1, wherein the first tape is thicker than the second tape.

7. The paper sheet storage device of claim 1, wherein the first tape is wider than the second tape.

8. The paper sheet storage device of claim 1, wherein the first tape has higher rigidity than the second tape.

9. The paper sheet storage device of claim 1, wherein the first and second tapes are wound around the drum to overlap with each other in the radial direction of the drum.

10. The paper sheet storage device of claim 1, wherein the first and second tapes are wound around the drum not to overlap with each other in the radial direction of the drum.

11. A paper sheet handling machine comprising the paper sheet storage device of claim 1.

* * * * *